US009970725B2

(12) United States Patent
Kiyani et al.

(10) Patent No.: US 9,970,725 B2
(45) Date of Patent: May 15, 2018

(54) QUICK ACCESS FIREARM SAFETY APPARATUS

(71) Applicant: SENTINL INC., Detroit, MI (US)

(72) Inventors: Omer Kiyani, Detroit, MI (US); Patrick Leo Pawlowski, Grosse Pointe Farms, MI (US)

(73) Assignee: Sentinl, Inc., Detroit, MI (US)

( * ) Notice: Subject to any disclaimer, the term of this patent is extended or adjusted under 35 U.S.C. 154(b) by 0 days. days.

(21) Appl. No.: 14/932,553

(22) Filed: Nov. 4, 2015

(65) Prior Publication Data

US 2016/0054083 A1 Feb. 25, 2016

Related U.S. Application Data

(63) Continuation-in-part of application No. PCT/US2014/036969, filed on May 6, 2014.

(60) Provisional application No. 61/819,688, filed on May 6, 2013, provisional application No. 61/836,111, filed on Jun. 17, 2013.

(51) Int. Cl.
*F41A 17/54* (2006.01)
*F41A 17/06* (2006.01)

(52) U.S. Cl.
CPC ..... *F41A 17/54* (2013.01); *F41A 17/06* (2013.01); *F41A 17/063* (2013.01); *F41A 17/066* (2013.01)

(58) Field of Classification Search
CPC ..... F41A 17/06; F41A 17/066; F41A 17/063; F41A 17/46; F41A 17/54
USPC ..... 42/70.01, 70.06, 70.07, 70.11
See application file for complete search history.

(56) References Cited

U.S. PATENT DOCUMENTS

| | | | | | |
|---|---|---|---|---|---|
| 1,686,482 | A | * | 10/1928 | Windle | F41A 17/54 42/70.06 |
| 1,887,308 | A | * | 11/1932 | Jessup | F41A 17/54 42/70.06 |
| 2,893,152 | A | * | 7/1959 | Peluso | F41A 17/54 42/70.06 |
| 3,269,046 | A | | 8/1966 | Schaefer | |
| 4,422,254 | A | | 12/1983 | McQueen | |
| 4,467,545 | A | | 8/1984 | Shaw, Jr. | |
| 4,509,281 | A | * | 4/1985 | Dreiling | F41A 17/54 42/70.07 |
| 5,012,605 | A | | 5/1991 | Nishioka | |
| 5,024,017 | A | | 6/1991 | Nishioka | |
| 5,062,232 | A | | 11/1991 | Eppler | |

(Continued)

FOREIGN PATENT DOCUMENTS

WO 9960324 A2 11/1999

*Primary Examiner* — Jonathan C Weber
(74) *Attorney, Agent, or Firm* — Brooks Kushman P.C.

(57) ABSTRACT

A firearm safety apparatus is provided that includes two or more locking arms or coverings connected by a hinge and configured to engage a trigger guard of a firearm, in a closed position preventing access to the trigger. A locking mechanism retains the arms in a closed position until opened by an activation signal. A firearm safety apparatus is also provided that includes a housing connected to a firearm. A trigger guard cover is slideably or hingably connected to the housing. A locking mechanism is coupled to the trigger guard cover to surround a trigger of the firearm until an activation signal is received. The locking mechanism exposes the trigger through a hinged or slide motion. The housing is amenable to inclusion of various tactical accessories such as a light source or a camera.

11 Claims, 31 Drawing Sheets

(56) References Cited

U.S. PATENT DOCUMENTS 5,075,994 A 12/1991 Nishioka
5,392,552 A 2/1995 McCarthy et al.
5,416,472 A * 5/1995 Torii, Jr. ..... A47B 81/005 211/64
5,417,000 A * 5/1995 Chen ..... F41A 17/02 42/70.06
5,419,068 A 5/1995 Pages et al.
5,487,234 A 1/1996 Dragon
5,502,915 A 4/1996 Mendelsohn et al.
5,561,935 A * 10/1996 McCarthy ..... F41A 17/54 42/70.07
5,603,179 A 2/1997 Adams
5,704,151 A * 1/1998 West ..... F41A 17/06 42/70.07
5,937,557 A 8/1999 Bowker et al.
6,098,330 A 8/2000 Schmitt et al.
6,154,995 A 12/2000 Lenoir et al.
6,253,480 B1 7/2001 Florez
6,260,300 B1 * 7/2001 Klebes ..... F41A 17/066 206/317
6,282,829 B1 9/2001 Mossberg et al.
6,286,240 B1 9/2001 Collins
6,293,039 B1 9/2001 Fuchs
6,339,892 B1 1/2002 Ramos
6,343,140 B1 1/2002 Brooks
6,389,726 B1 5/2002 Bentley
6,474,011 B1 11/2002 Sato
6,499,243 B1 12/2002 Herzog
6,843,014 B1 * 1/2005 Aponte ..... F41A 17/06 42/70.06
6,874,265 B1 * 4/2005 Pathak ..... F41A 17/54 42/70.06
6,925,742 B1 8/2005 Van Zyl
7,216,449 B2 * 5/2007 Riebling ..... F41A 17/54 42/70.06
7,584,566 B2 9/2009 Victor et al.
7,730,750 B2 6/2010 Victor
8,037,632 B2 10/2011 Pikielny
8,186,088 B2 5/2012 Victor et al.
8,713,836 B1 5/2014 Haq
9,243,858 B1 * 1/2016 Stiles ..... F41A 17/066
2004/0216349 A1 11/2004 Riebling et al.
2008/0134556 A1 6/2008 Remelin
2009/0007476 A1 * 1/2009 Mauch ..... F41A 17/063 42/1.01
2010/0107465 A1 5/2010 Pintar et al.
2011/0047849 A1 3/2011 Brenner
2012/0011756 A1 1/2012 Do Amarante et al.
2012/0137559 A1 6/2012 Burns, III
2012/0291327 A1 * 11/2012 Boutot, Jr. ..... F41C 33/0263 42/70.11
2013/0312306 A1 * 11/2013 Ruffin ..... F41A 17/066 42/70.07
2014/0182180 A1 7/2014 Murphy, II et al.
2014/0230300 A1 * 8/2014 Haq ..... F41A 17/54 42/70.06
2016/0025439 A1 * 1/2016 Stiles ..... F41A 17/066 42/70.07

* cited by examiner

QUICK ACCESS FIREARM SAFETY APPARATUS

CROSS-REFERENCE TO RELATED APPLICATIONS

This application is a Continuation-In-Part of PCT application no. PCT/US2014/036969, filed May 6, 2014, titled QUICK ACCESS FIREARM SAFETY APPARATUS, which claims the benefit of U.S. Provisional Application Ser. Nos. 61/819,688 and 61/836,111 filed May 6, 2013; and Jun. 17, 2013; respectively, the contents of which are hereby incorporated by reference in their entirety.

FIELD OF THE INVENTION

The present invention in general relates to firearm safety and, in particular, to a safety apparatus to prevent the accidental discharge of a weapon by an unauthorized individual to whom the weapon does not belong or lacks permission to use.

BACKGROUND OF THE INVENTION

Gun safety is a collection of rules and recommendations that can be applied when possessing, storing, or handling firearms. The purpose of gun safety is to eliminate or minimize the risks of unintentional death, injury or damage caused by improper possession, storage, or handling of firearms.

One third of all Americans own a gun, and since the majority of these guns are used for home defense purposes, an estimated fifty percent are kept loaded and unlocked. It has been reported that in 2010 alone, 15,575 children were injured with unlocked guns. Furthermore, in one year on average, more than 16,300 Americans are shot accidently, and 584 die from their injuries.

Thus, there exists a need for improved devices for locking and securing firearms that retain the ability to be rapidly deployed.

SUMMARY OF THE INVENTION

A firearm safety apparatus is provided that includes two or more locking arms connected by a hinge and configured to prevent access to a firearm, e.g., by being configured to surround a trigger guard of a firearm, when the locking arms are in a closed position. A locking mechanism retains the arms in a closed position until opened by an activation signal. The firearm safety apparatus prevents access to the trigger in an example. The firearm safety apparatus prevents movement of the trigger in an example.

A firearm safety apparatus is also provided that includes a housing connected/latched to a firearm. A trigger guard cover is slideably or hingably connected to the housing. A locking mechanism is coupled to the trigger guard cover to surround a trigger of the firearm until an activation signal is received. The locking mechanism exposes the trigger through a hinged or slide motion. The housing is amenable to inclusion of various tactical accessories such as a light source or a camera. The trigger guard housing includes two arms to cover the trigger and/or the trigger guard with the two arms being biased into an open position and being held in a closed position to prevent access to the trigger.

A firearm safety apparatus is also described that includes a housing to prevent access to a trigger of a firearm, the housing having a first locking arm and a second locking arm pivotally joined to the first locking arm at a joint, wherein the first arm and the second arm being movable from a closed position configured to engage a firearm and to prevent access to a trigger on the firearm to an open position allowing access to the trigger. A biasing member, e.g., a spring or mechanical biasing device, is provided to bias at least one of the first locking arm and the second locking arm in the open position. A locking mechanism is provided to retain the first and second locking arms in the closed position until opened by an electrical activation signal allowing the biasing member, e.g. the spring, to open the housing. In an example, the locking mechanism includes a mechanical lock to unlock said first and second locking arms from the closed position to the open position.

In an example, a biometric sensor is supported on the housing to sense a user at the firearm. Controller circuitry is configured to receive a signal from the biometric sensor and to match the received signal to a stored signal and when a match is found send the activation signal to the locking mechanism to open the housing and allow access to the trigger of the firearm.

In an example, the locking mechanism includes a latch that is moveable relative to a catch when the activation signal is issued or the mechanical lock moves the latch.

In an example, the locking mechanism further includes a shape memory alloy wire that retracts when the activation signal is received to move the latch from the catch and allow the first arm and the second arm to move apart and allow access to the trigger of a firearm.

In an example, the mechanical lock includes a key tumbler and linkage connecting the key tumbler to the latch to move the latch to the unlatched position upon movement of the key tumbler.

In an example, the controller circuitry includes a rechargeable power source and a memory to store at least one fingerprint profile. The controller circuitry has a training mode to store a fingerprint profile at the biometric sensor in the memory and an access mode that compares an access fingerprint profile at biometric sensor to the fingerprint profile stored in the memory.

In an example, the first arm is biased away from the second arm, e.g., by the biasing member.

In an example, the first arm and second arm are openable to about 10 degrees to release the trigger guard.

In an example, the joint defines a pivot line for the first and second arms to move between the open and closed positions.

In an example, the latch extends at an angle between about 50 degrees to 65 degrees relative to the pivot line.

In an example, the shape memory alloy wire extends at an angle in a range of about 25 degrees to 35 degrees relative to the pivot line.

In an example, the housing is shaped to leave a space between the housing a firearm grip such that a user can hold the grip with the housing being in the closed position preventing access to the trigger.

BRIEF DESCRIPTION OF THE DRAWINGS

The present invention is further detailed with respect to the following non-limiting specific embodiments of the present invention. The appended claims should not be construed as being limited to the specific devices so detailed.

DETAILED DESCRIPTION OF THE INVENTION

Figure 1:
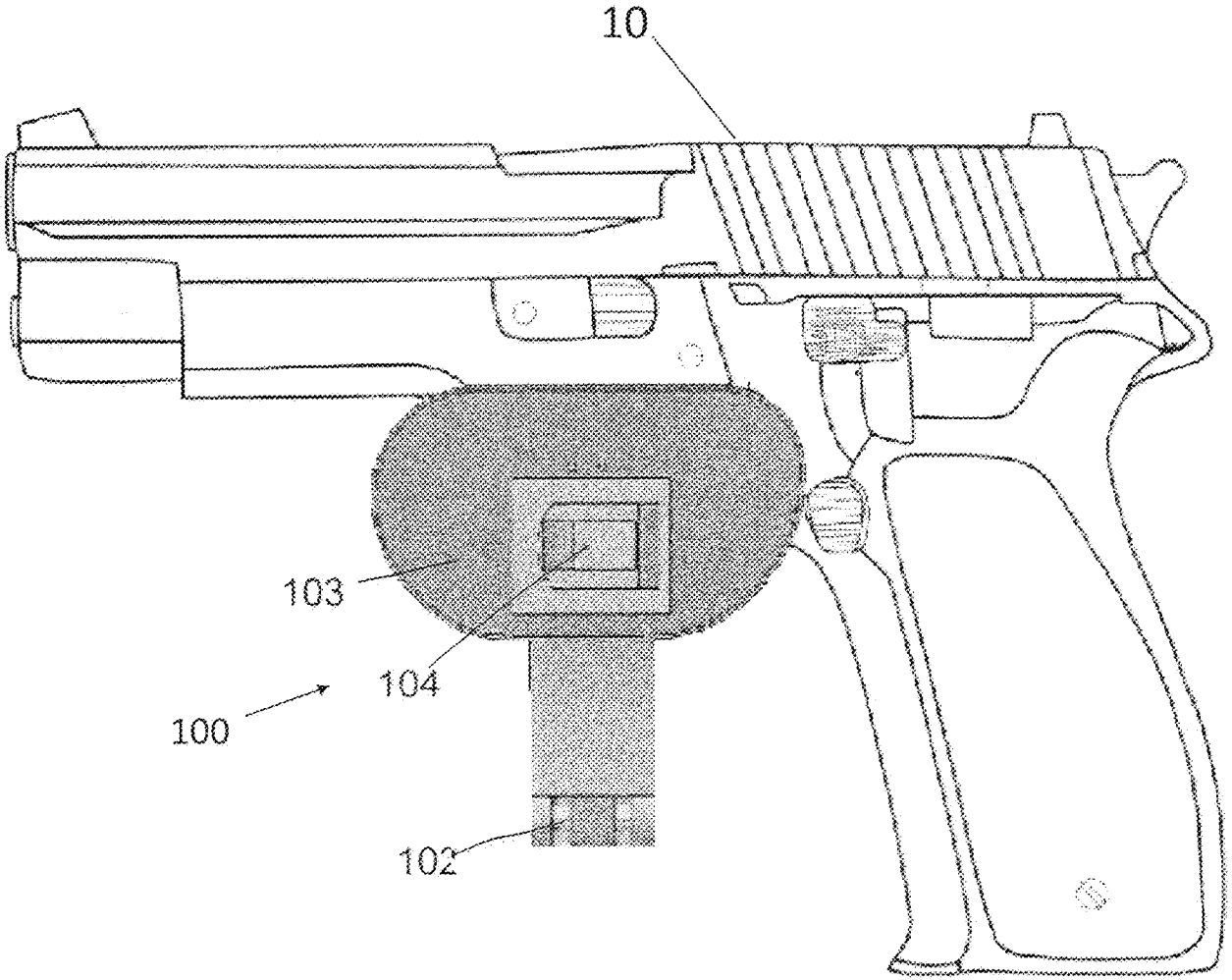
FIG. 1 shows a side view of an exemplary embodiment of a quick access firearm safety apparatus attached to a firearm, in accordance with an embodiment of the present invention.
Figure 2:
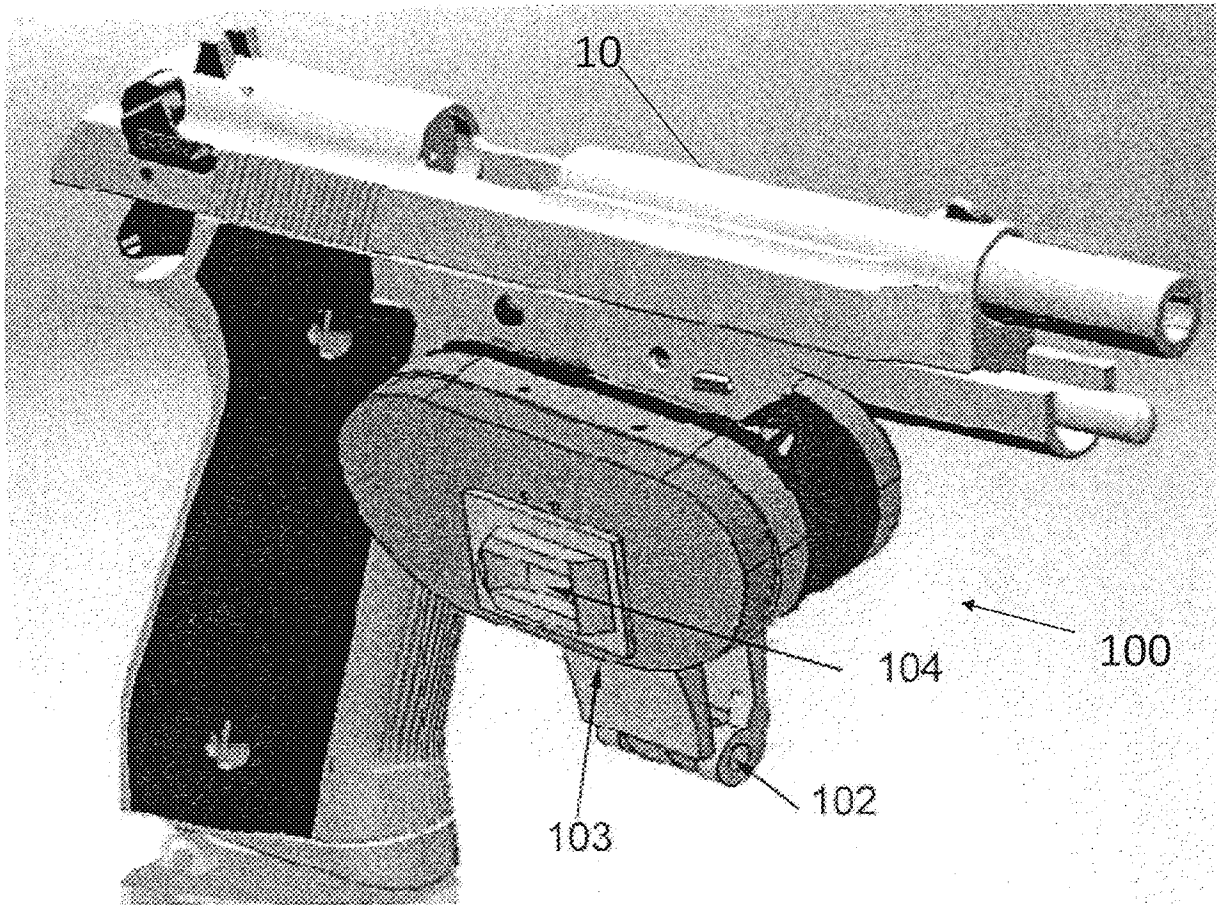
FIG. 2 shows a perspective view of an exemplary embodiment of a quick access firearm safety apparatus attached to a firearm, in accordance with an embodiment of the present invention.
Figure 3:
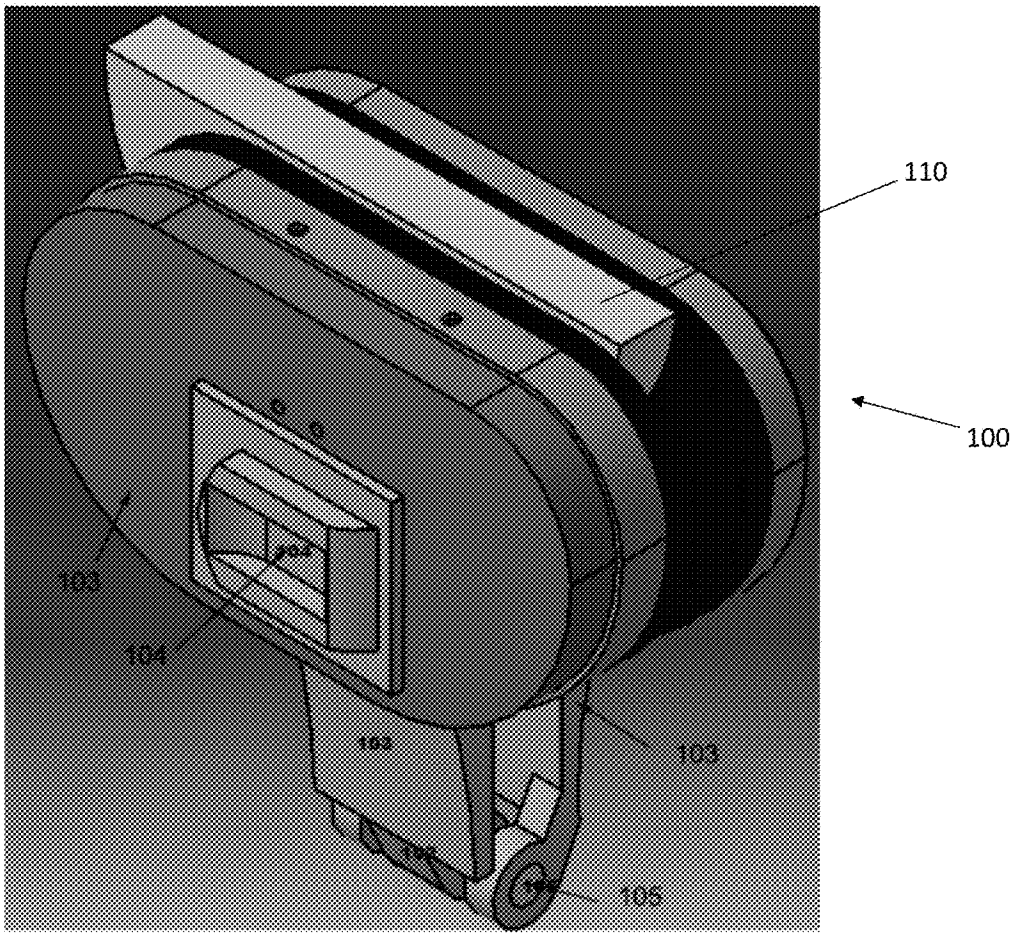
FIG. 3 shows a perspective view of an exemplary embodiment of a quick access firearm safety apparatus, in accordance with an embodiment of the present invention.
Figure 4:
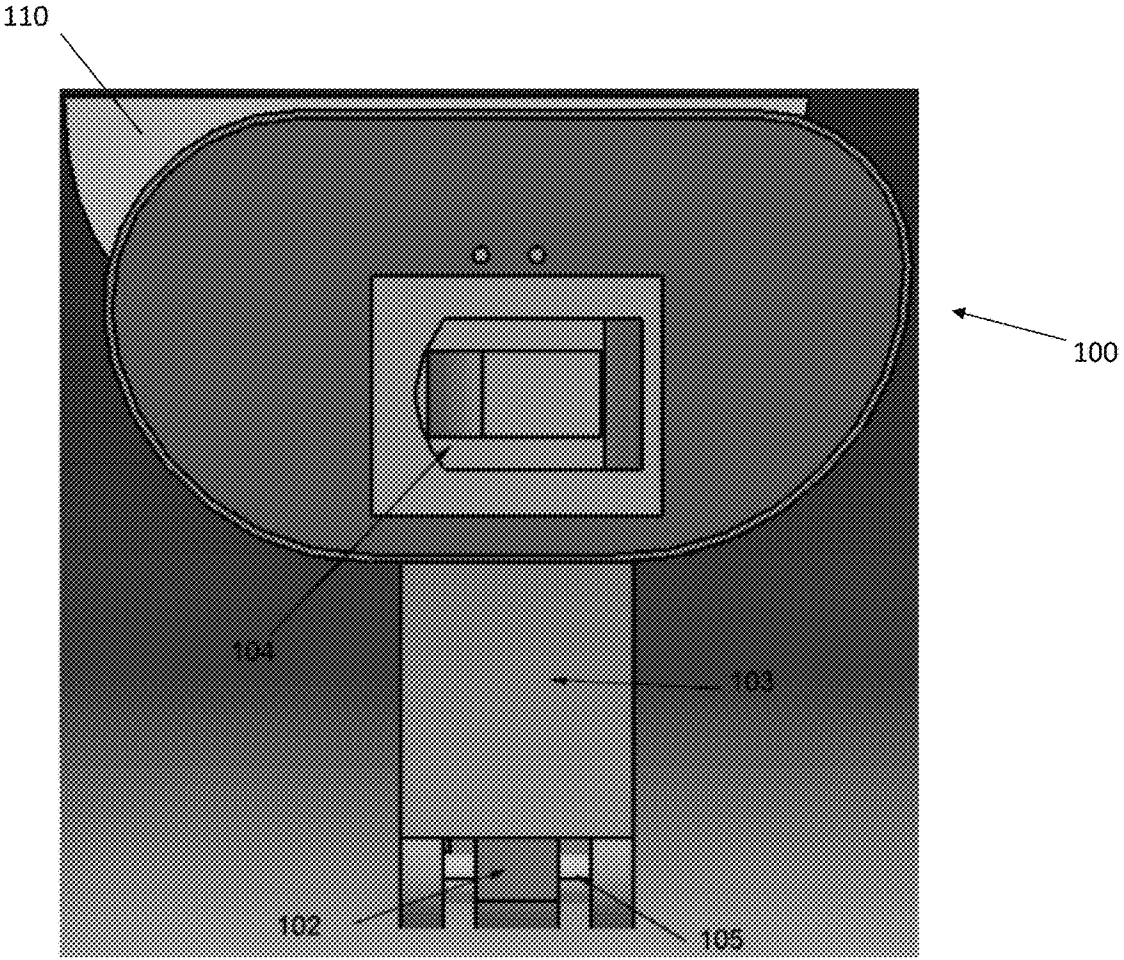
FIG. 4 shows a side view of an exemplary embodiment of a quick access firearm safety apparatus, in accordance with an embodiment of the present invention.
Figure 5:
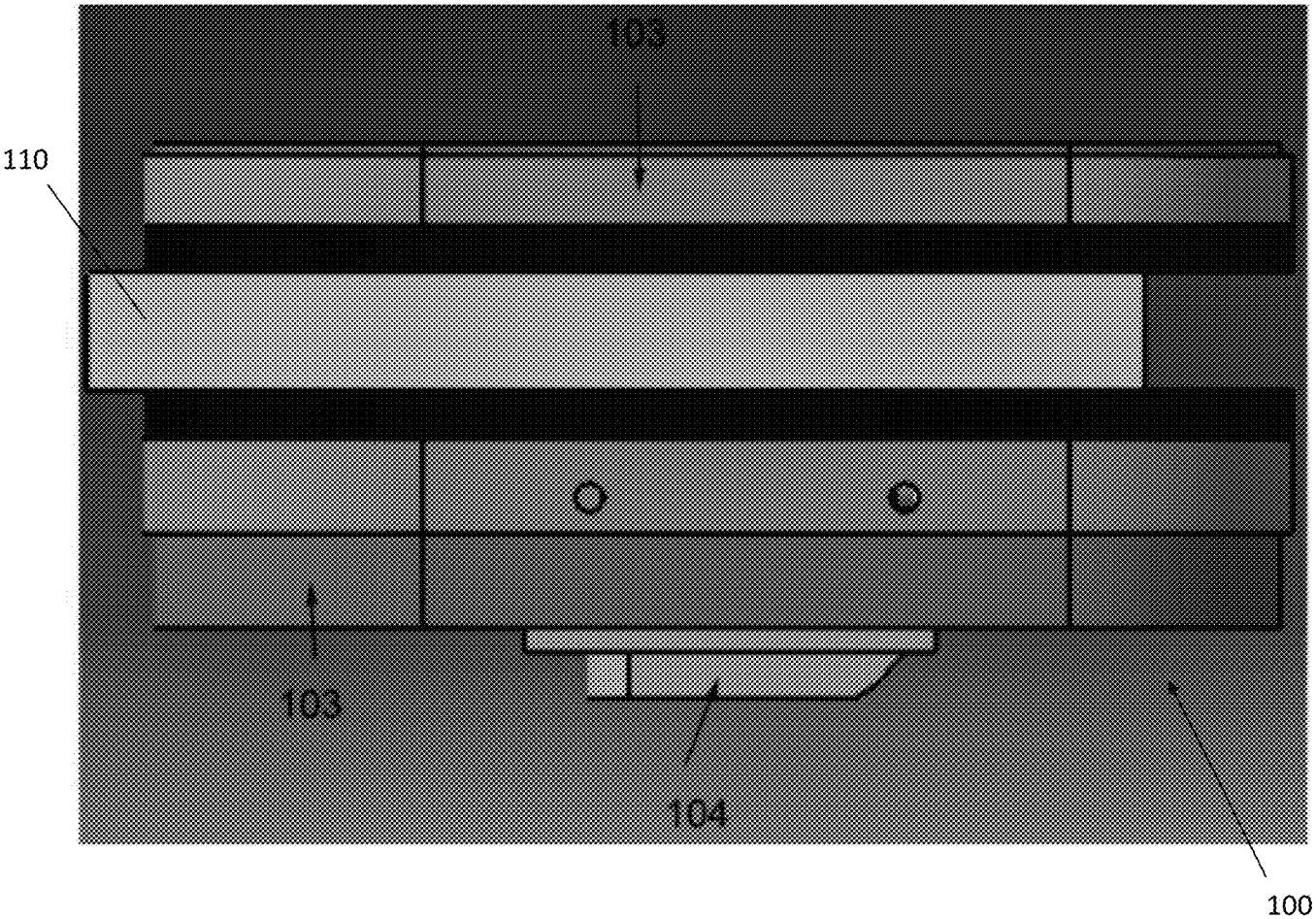
FIG. 5 shows a top view of an exemplary embodiment of a quick access firearm safety apparatus, in accordance with an embodiment of the present invention.
Figure 6:
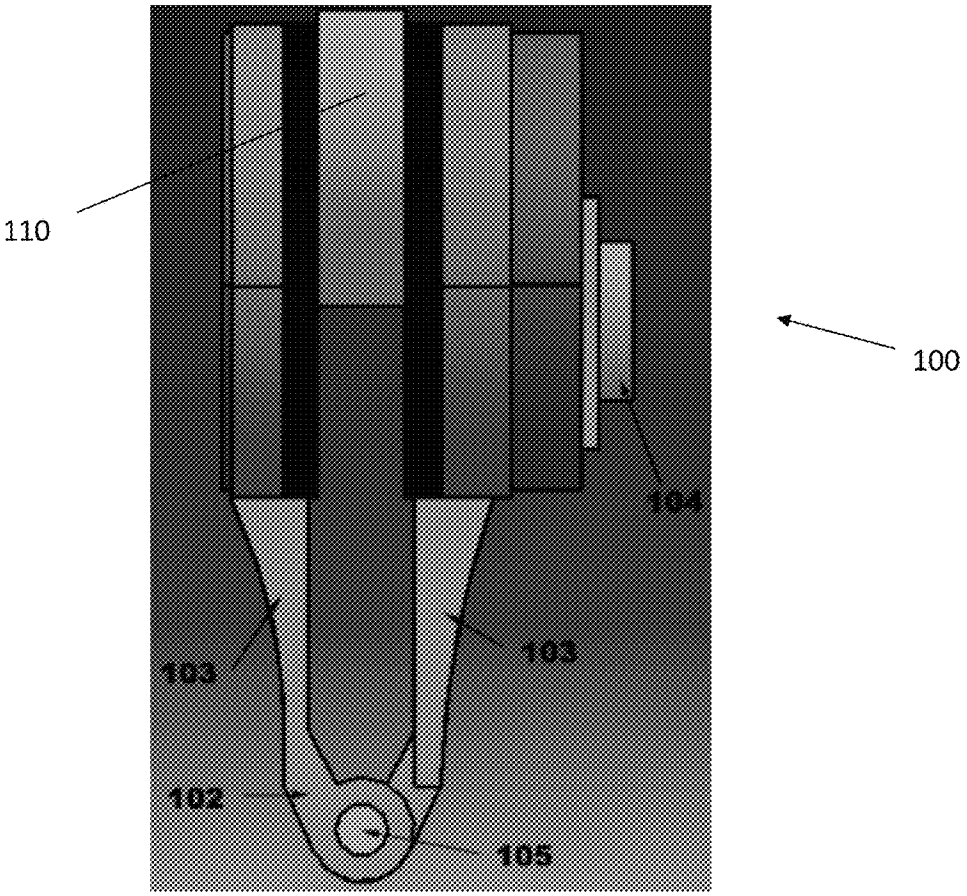
FIG. 6 shows a front view of an exemplary embodiment of a quick access firearm safety apparatus, in accordance with an embodiment of the present invention.

The present invention has utility as a quick access firearm safety apparatus.

Embodiments of the inventive firearm safety apparatus provide a gun owner quick access to a loaded firearm, while preventing unauthorized access by children and unauthorized individuals.

As a result, the rapid deployment security attributes of a firearm are retained while unauthorized discharge is assured. Embodiments of the inventive firearm safety apparatus utilize a variety of activation signals to unlock the firearm. These signals are derived from sources that illustratively include biometric fingerprint identification, radio frequency identification (RFID), Near Field Communication (NFC), voice authentication, to allow an authorized user access to a firearm locked by an inventive apparatus essentially immediately. A firearm safety apparatus is provided that allows a gun owner quick access to a firearm, while preventing unauthorized access by children and unauthorized individuals. The apparatus utilizes biometric fingerprint identification as well as radio frequency identification (RFID), voice authentication, and other methods to provide an activation signal that actuates a rapid-release mechanism that allows an authorized user access to a gun essentially immediately.

In some embodiments of the present invention, an inventive apparatus surrounds the trigger guard and has not aspect enter into the interior volume defined by the trigger guard. As a result, certain inventive embodiments facilitate the use of the present invention as described herein with respect to various embodiments to couple to a loaded gun without fear of concussive accidental discharge of the firearm. In an example, the trigger guard does not have an aspect adjacent the trigger but may have a projection inside the trigger guard remote from the trigger. In an example the projection does not extend fully through the trigger guard.

The inventive apparatus also provides visibility at night with a glow-in-the-dark feature in some embodiments using LED or fluorescent material. The inventive apparatus allows for mobility of the gun in a locked and loaded state in some embodiments. In still other embodiments, the apparatus after unlocking remains attached to the firearm, even when the user has the gun in firing position. A key-override on the apparatus is provided in some embodiments that may be used to detach the device from the gun, and to override apparatus electronics. Embodiments of the inventive firearm safety apparatus may also be configured with locking slot adapted to secure a cable, similar to a laptop lock to secure the firearm to a non-movable object in various locations, and in a cabinet or safe.

Embodiments of the inventive firearm safety apparatus slide and locks onto grooves of a "lightrail"; this term is used herein interchangeably with "Picatinny rail", "universal rail", "tactical rail", "Weaver rail", or "accessories rail with respect to the the firearm. The inventive lock covers the trigger guard area thereby preventing access to the firearm and disabling the firearm. The trigger guard cover is spring loaded, it slides to uncover trigger guard area thus allowing quick enabling of a firearm for an authorized user. In other specific embodiments, the trigger guard cover pivots on a hinge. The apparatus can entirely be removed from firearm using key to unlock A controller is provided in some embodiments to actuate the trigger guard cover and the microcontroller/microprocessor also controls activation methodology. Activation signals provided by embodiments of the inventive firearm safety apparatus include a combination lock having buttons, a touch LCD screen, a biometric fingerprint sensor, RFID sensor, voice activation, cell phone (voice, code combination, etc.), and global positioning signal (GPS). In a further embodiment, the fingerprint sensor is sticker based so that a user may define a custom sensor position. Alternatively, a fingerprint sensor sticker may be made wide enough to allow activation from either side of the gun handle for an ambidextrous user. When a successful identification match occurs via the activation signal receipt, the firearm safety apparatus unlocks the gun.

The biometric sensor may be fixed to a side of the housing of the firearm safety apparatus. The sensor may be aligned with where a user may extend one of the user's fingers, e.g., the index finger, when the user is holding the grip of the firearm. The user may engage the grip to hold the firearm with the user's fingers in a space between the grip and the housing of the firearm safety apparatus.

Embodiments of the inventive firearm safety apparatus are portable and battery powered. A low battery indicator or an audible alarm warns a user that the firearm safety apparatus battery requires a recharge. Recharging methods may include the attachment of a power cable or a universal serial bus (USB) cable to the firearm safety apparatus and to an AC/DC converter. The USB cable is attached at a data entry port which is also used for programming the firearm safety device. In a specific inventive embodiment, device is internet enabled (connected device) allowing software updates to be automatically downloaded with new features and upgrades. In a specific inventive embodiment, an induction mat that provides wireless charging may be used to charge the device. With an induction mat, the firearm safety apparatus can be placed on the induction charging mat/tray so that while the gun is placed in storage the safety apparatus is being charged. The induction mat could also be configured with USB ports to charge cell phones and other mobile devices. The induction mat could also have additional home emergency items built in like weather radio, iPod Dock, alarm clock night light, coffee maker, condom dispenser etc. Additional means to charge the firearm safety apparatus include solar cells and motion energy when the apparatus is carried. In still other embodiments, limited components of an inventive apparatus are powered such as a sensor or a controller to afford operational lifetimes for a battery of more than a year in some instance and more than two years in other instances.

Embodiments of the inventive firearm safety apparatus may be configured to conserve battery power based on an energy saving algorithm. In a specific embodiment, the safety apparatus would go into low or no power draw mode after use or during storage, and switch to fully powered mode based on a signal from a motion sensor associated with an inventive device. In response to a detected motion, the motion sensor would activate the controller, which in turn would wake up other systems. In some embodiments, the motion detection algorithm detects the magnitude of the movement and determines if the movement exceeds a threshold. It is appreciated that a dynamic threshold is readily created to account for routine movement associated with the apparatus is in a car, being carried, or the like and thereby remain in a low energy draw mode. In certain inventive embodiments, a proximity sensor detects an approaching user and powers the apparatus from a low power mode. It is appreciated that a proximity sensor operates on various principles including motion, thermal signatures of a human, chemical signals associated with human respiration or metabolism, or a combination thereof. In addition, voice activation via a cell phone or on the apparatus itself is also readily used to power up the controller. In certain inventive embodiments, the system would turn on only based on pushbutton activation which occurs when user's finger is pressed onto fingerprint sensor. The voice activation may be coupled with voice authentication to insure that only a valid user can wake up the firearm safety device. The voice activation may also be used to turn on lights on the apparatus for improved visibility. These lights illustratively include an LED, a laser, or a flashlight, a strobe light or a combination thereof. In certain inventive embodiments, the sensor is placed on a push button such that system would only wake up when sensor is slightly pressed thus eliminating drainage current to zero significantly extending battery life Additional features that may be available on embodiments of the inventive firearm safety apparatus illustratively include a camera, a night vision reticle, Wi-Fi, Bluetooth, GPS, and a compass. Embodiments of the inventive firearm safety apparatus may be integrated with a home security system, or inventory control systems associated with an institution such as the military, law enforcement, or a security organization. For example, during a home invasion the inventive apparatus can be induced to automatically disable thereby preventing an intruder from using the locked firearm. Similarly, a lost, stolen, or captured firearm equipped with an inventive apparatus is disabled, tracked, or even permanently inoperative with various embodiments of the present invention. Disabling and tracking of a firearm safety apparatus are readily performed through convention wireless communication technologies. Inclusion of a thermite charge that can be remotely initiated through such wireless communication allows for fusion of the firearm when under unauthorized control.

Embodiments of the camera employed in the firearm safety apparatus may be configured to broadcast live footage to a variety of devices like wearable head displays, cellphones, mobile electronics, and internet enabled devices. Camera broadcasts may be conducted over Wi-Fi or Bluetooth to the Internet, via cellular infrastructure, VHF, UHF, satellite, etc. With the camera mounted to the firearm safety device, a user is enabled to shoot without line of sight (around the corner), at night, etc. Live footage from the camera would show a variety of information such as a bull's eye, or a target sighting. A firearm outfitted with the safety apparatus can be taken to the range and automatically sighted in because the camera algorithm can be configured to detect patterns or dispersion of shots at a target. In addition, distance can be displayed on the camera footage to allow a user to tweak their aim to account for the distance to the target. The camera can be configured to take a series of pictures before/during/after every shot, and store/upload these pictures to be used by law enforcement or hunters to identify where shots were fired with a threat or target visible. Furthermore, the built-in camera algorithm may be configured to detect faces and have night vision, so as to identify names of potential targets, (connected online or with built in memory), and would enable features like identification of friendly targets, and could eliminate friendly fire like hitting a family member at night or in the dark. The vision identification feature may provide a user notification/identification that the line of sight includes a friendly target. The notification/identification could also be accompanied with a slight vibration. While the present invention is further illustrated through drawings depicting a handgun, it is appreciated that an inventive apparatus is readily deployed on rifles, shotguns, electroshock weapon (e.g., a Taser by Taser International of Scottsdale, Ariz., chemical self defense spray devices (e.g., mace)., as well as a variety of potentially dangerous tools having a trigger. Such tools illustratively include a sprayer, nail gun, a saw, a torch, and the like.

Figure 10:
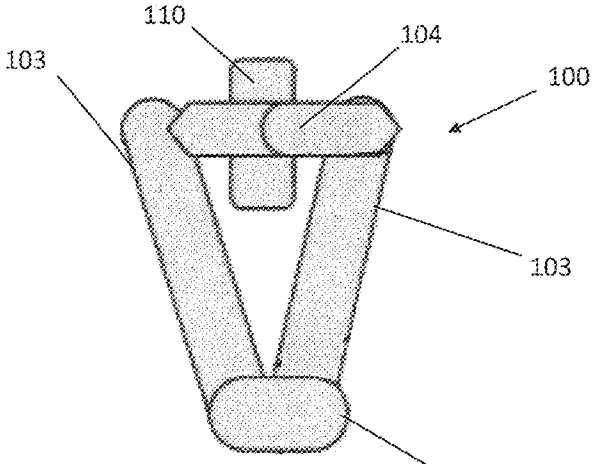
FIG. 10 shows a diagram of an exemplary embodiment of a quick access firearm safety apparatus, in accordance with an embodiment of the present invention.
Figure 11:
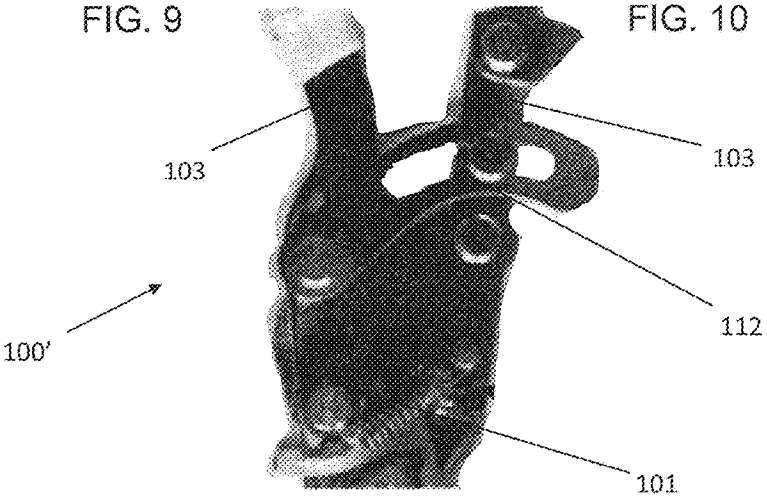
FIG. 11 shows an image of an exemplary embodiment of a locking means for a quick access firearm safety apparatus, in accordance with an embodiment of the present invention.

Referring now to the figures, FIGS. 1-11 shows a series of views of an exemplary embodiment of a quick access firearm safety apparatus 100 attached to a trigger guard 110 of a firearm 10, in accordance with an embodiment of the present invention. The firearm safety apparatus 100 includes one or more torsioners 101 (as shown in FIG. 11), a hinge 102, two or more locking arms 103 and a locking mechanism 104. In some embodiments, the quick access firearm safety apparatus 100 includes a controller 107 configured to allow verification of activation methodologies as described in detail below. Advantageously, these components form a single body firearm lock not seen before in the art. In a specific embodiment of the firearm safety apparatus 100, the components form a clam shell style clamp firearm lock. The hinge 102 connects to two locking arms 103 in such a manner that a cavity is formed between the hinge 102 and locking arms 103, with the cavity being ideally formed to be received upon a trigger guard 110 in such a manner that prevents access to the trigger and thereby disables the ability of the firearm 10 to be discharged.

Further, in inventive embodiments of the present invention a torsioner 101 provides an inward force or bias to the two locking arms 103 that drives the arms 103 towards one another as facilitated by the hinge 102 towards a closed or locking position. Alternatively, in specific embodiments the torsioner 101 is configured to provide a force such that the two or more locking arms 103 are biased or favored towards an open and unlocked position. Favoring an open and unlocked position may be useful where quick release and use of the firearm 10 may be desired (e.g., usage in conjunction with a holster or other quick draw or quick fire means). A torsioner 101 as used herein illustratively includes a leaf spring, a coil spring, a torsion bar, a pneumatic cylinder, or any combination thereof. The locking mechanism 104 is configured to secure the two locking arms 103 together in such a manner that prevents removal of the firearm safety apparatus 100 from a firearm 10 once locked.

According to another embodiment of the present invention, the hinge 102 is configured to attach two or more locking arms 103 and allow movement of the two or more locking arms 103 along axes such that the two or more locking arms 103 can be received around a trigger guard 110 of a firearm 10 in order to prevent the usage of a firearm until such time as the firearm safety apparatus 100 is disengaged. In certain embodiments, the hinge 102 includes a single joint, such as a cylinder on which the two locking arms 103 are received. In other inventive embodiments, the hinge 102 includes two or more joints, allowing for additional space to be included between the locking arms 103 or for the utilization of more than two locking arms 103 (e.g., a third locking arm facing towards the barrel of the firearm 10 that can be moved into a locking position in order to completely encircle a trigger guard and trigger of a firearm 10). In specific embodiments of the inventive firearm safety apparatus 100, the two or more locking arms 103 are configured to completely surround the trigger guard 110 of a firearm 10 when in a closed position. In still other embodiments, the locking arms 103 may contain a locking mechanism 104 that is configured to lock the two or more arms together until the appropriate activation methodology is taken to unlock the apparatus 100. The locking arms 103 may further contain a controller 107 and the components thereof that illustratively include a power source and a sensor.

According to an embodiment of the present invention, the locking mechanism 104 includes any number of locking components, split between the two or more locking arms 103 such that the apparatus 100 may be securely locked to a trigger guard 110 of a firearm 10 until such time as an appropriate activation signal is utilized to unlock the locking mechanism 104. Locking mechanism 104 illustratively includes a latch and hook lock, a geared lock, a cam lock, a cylinder lock, an electronic lock, a magnetic lock, a level tumbler lock, an electric strike lock, or any combination thereof.

According to an embodiment of the present invention, the locking mechanism 104 may be controlled by one or more of activation signal inputs. Activation signals for unlocking and locking a locking mechanism 104 illustratively include a combination lock (e.g., 3 numbers, 4 numbers, 5 numbers), a touchscreen apparatus for receiving an input (e.g., password, numeric code), an RFID sensors configured to interact with a key fob or other matching pair device, voice activation/recognition module, a cellular communications module (e.g., receive voice unlock command, receive code), a biometric fingerprint sensor, or any combination thereof According to an embodiment of the present invention, the quick access firearm safety apparatus 100 includes a controller 107 for providing verification of activation methodologies.

The controller 107 may include one or more of a processor, a memory (e.g., RAM, ROM), a storage medium (e.g., flash memory), a circuit board, a sensor (e.g., biometric sensor, voice recognition sensor, fingerprint sensor, pattern recognition sensor, motion sensor, proximity sensor) and a series of computerized instructions for instructing the controller to take one or more specified actions. For the purpose of this specification, the term "controller" is used to describe the electronics for providing verification of activation signals, and is inclusive of one or more of a microcontroller or a computing circuitry. In certain embodiments a controller may further include a communications receiver or transceiver. Communications modules operative herein illustratively include wireless communications means (e.g., Bluetooth, Wi-Fi, CDMA, GSM, 3G, 4G), wired communications means (e.g., Ethernet, USB, HDMI, firewire, thunderbolt) or any combination thereof.

According to an embodiment of the present invention, the controller 107 is configured to handle processing of the activation signals, and verify the entry of a correct answer/code/biometric input or whatever activation signal is utilized. Upon receipt and verification of an appropriate activation signal, the controller 107 sends an signal directly to the locking mechanism 104 or otherwise indirectly disengage the locking mechanism (e.g., via a an electromechanical component). It is appreciated that the signal sent from the controller 107 is in received activation signal or an electrically modified derivative thereof.

According to an embodiment of the present invention, the firearm safety apparatus 100 may further include a lock slot 105. In certain inventive embodiments, the lock slot 105 is configured to receive a cord, or cable for securing the apparatus to an object or individual. For instance, a security cord may be attached to the lock slot 105 and locked thereupon with the other end of the security cord being attached to secured object (e.g., wall mount, desk, safe, belt of a police officer). When secured, the apparatus 100 cannot be taken beyond the length of the tether means. When used in conjunction with a firearm, these limits the distance the firearm can travel without being unsecured from the apparatus 100.

Figure 7:
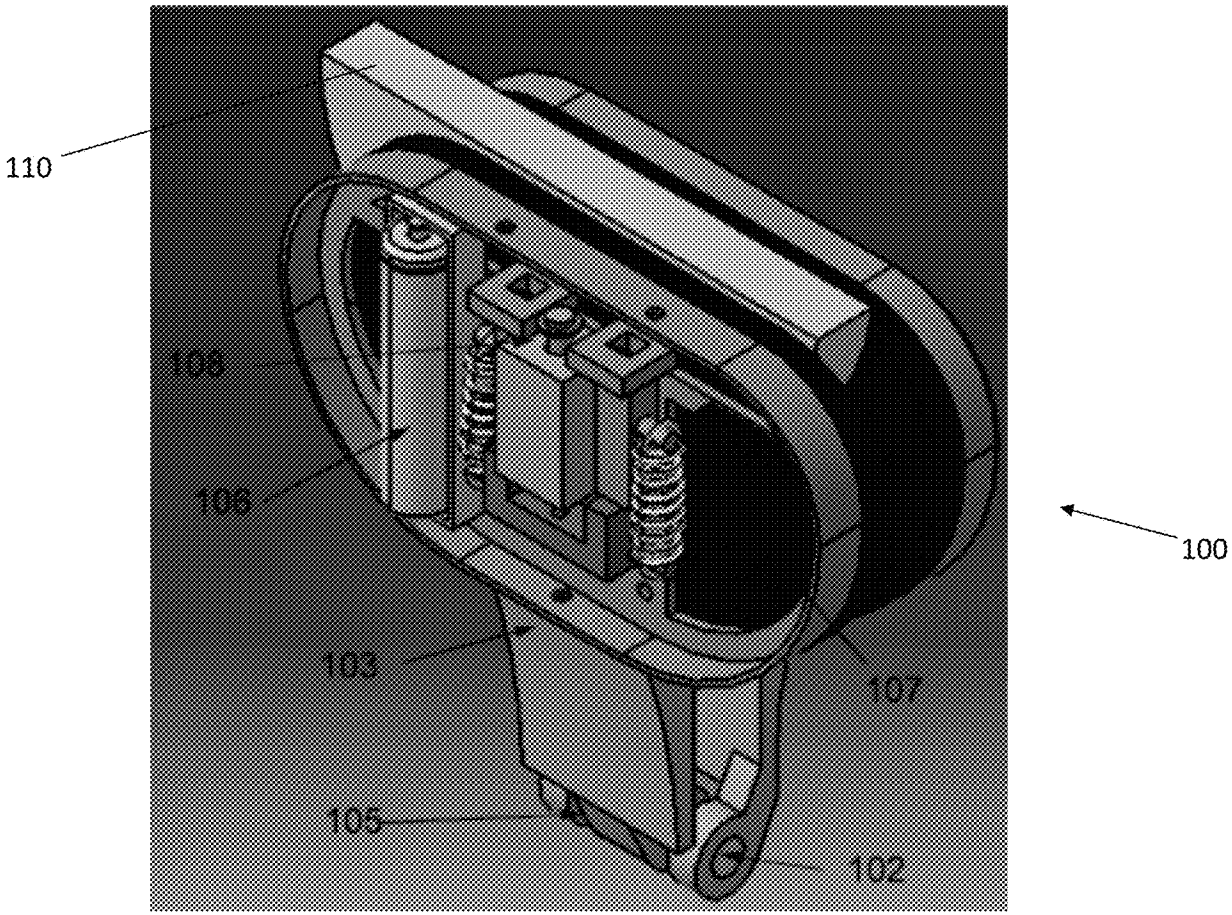
FIG. 7 shows a cross-sectional perspective view of an exemplary embodiment of a quick access firearm safety apparatus, in accordance with an embodiment of the present invention.
Figure 8:
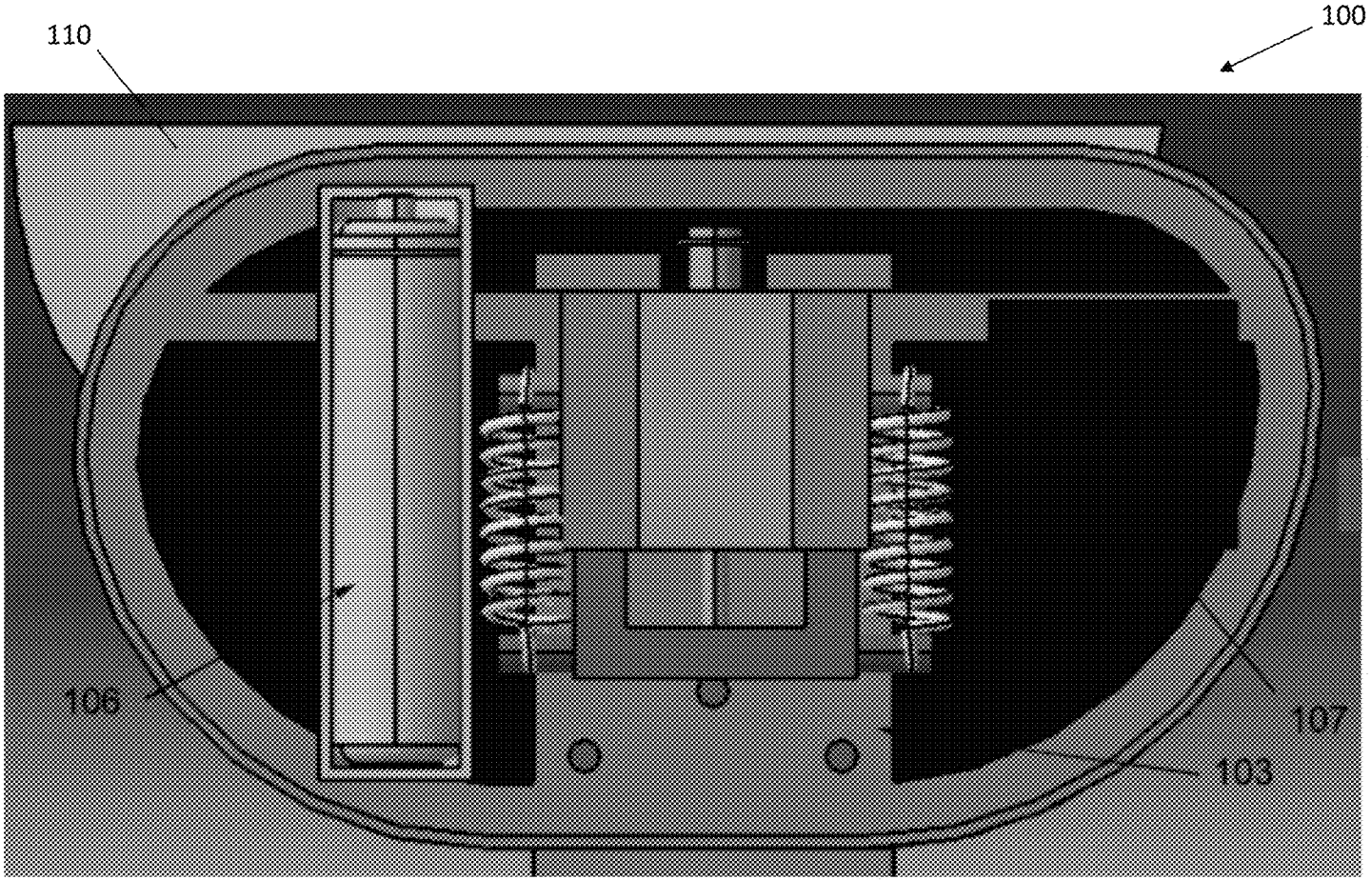
FIG. 8 shows a cross-sectional side view of an exemplary embodiment of a quick access firearm safety apparatus, in accordance with an embodiment of the present invention.
Figure 9:
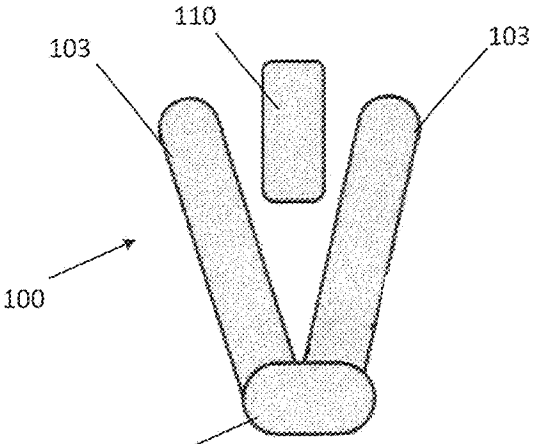
FIG. 9 shows a diagram of an exemplary embodiment of a quick access firearm safety apparatus, in accordance with an embodiment of the present invention.

FIGS. 7 and 8 show cross-sectional views of an embodiment of the firearm safety apparatus 100. In these views, the internal workings of a locking arm 103 are shown. A power source (e.g., battery) 106 is shown, which powers a controller 107 and an electromechanical component 108 allowing for the locking and release of the locking means 104 incorporated into the locking arm. FIGS. 9-11 show diagrams of the apparatus and locking means in accordance with embodiments of the present invention. FIG. 9 details the apparatus 100 as it engages around a trigger guard 110. FIG. 10 details the locking of the apparatus onto a trigger guard 110. FIG. 11 shows a locking mechanism 100' having a spring 101 using a gear locking mechanism 112. By way of example, an electromechanical component illustratively includes a solenoid, a stepper motor, Shape Memory Alloy (SMA) or a rotary electric motor, or any combination thereof.

Figure 12:
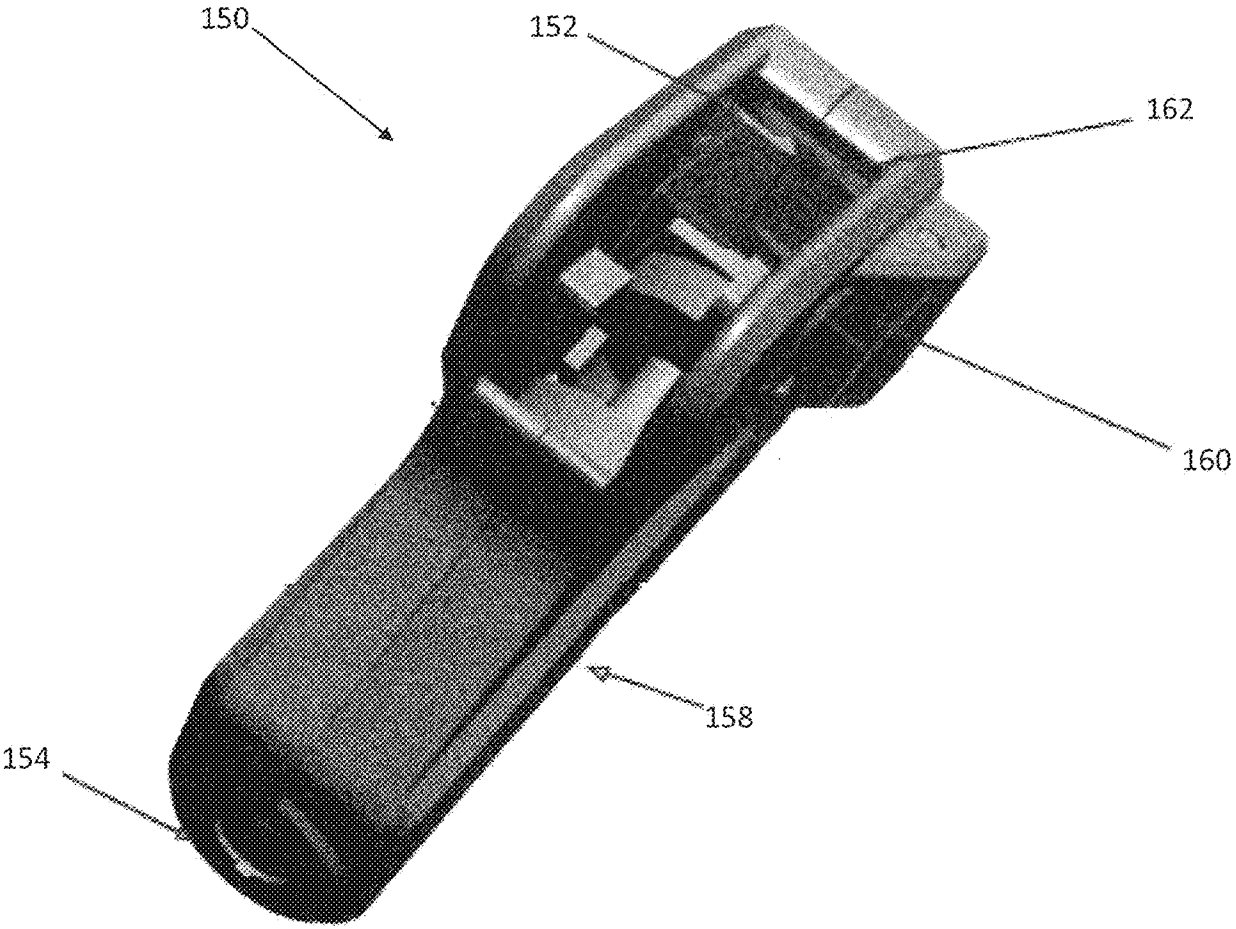
FIG. 12 shows a perspective view of an exemplary embodiment of a locking means in a closed state for a quick access firearm safety apparatus, in accordance with an embodiment of the present invention.
Figure 13:
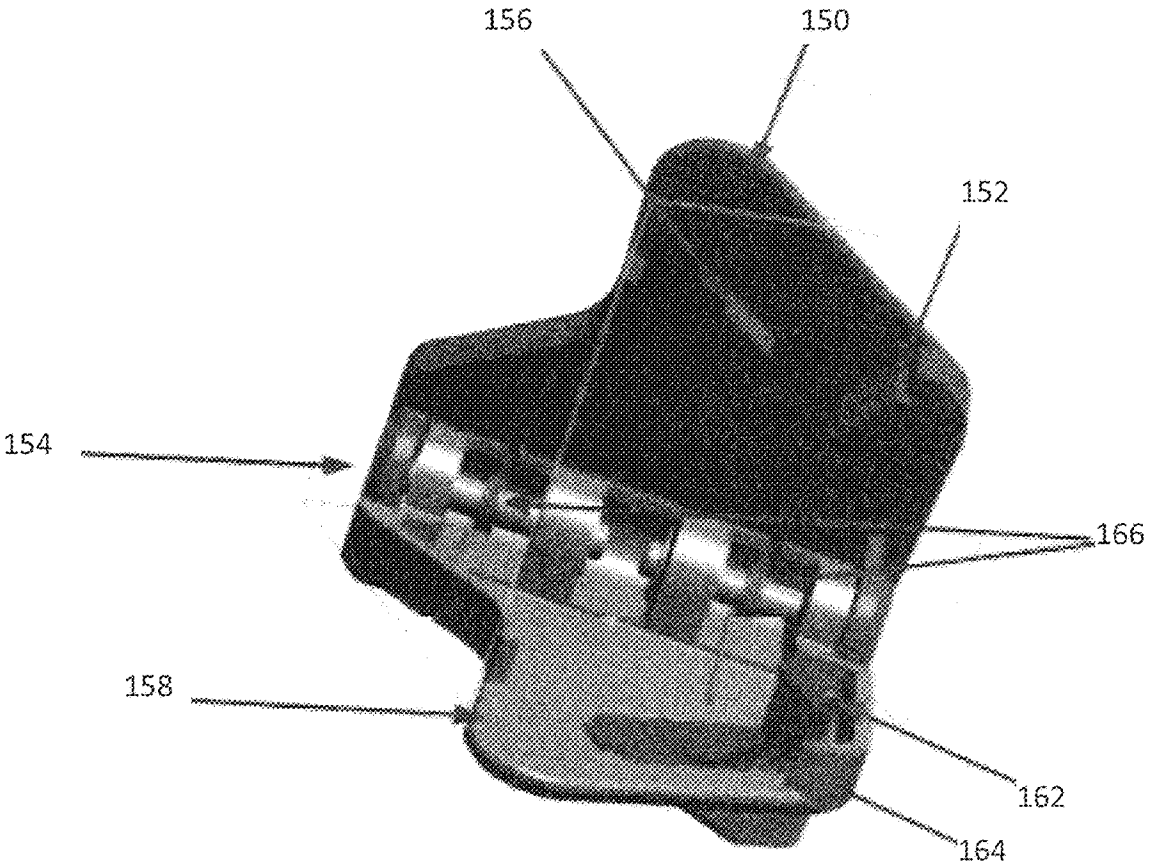
FIG. 13 shows a view of an exemplary embodiment of a locking means in an unlocked or open position for a quick access firearm safety apparatus, in accordance with an embodiment of the present invention.
Figure 14:
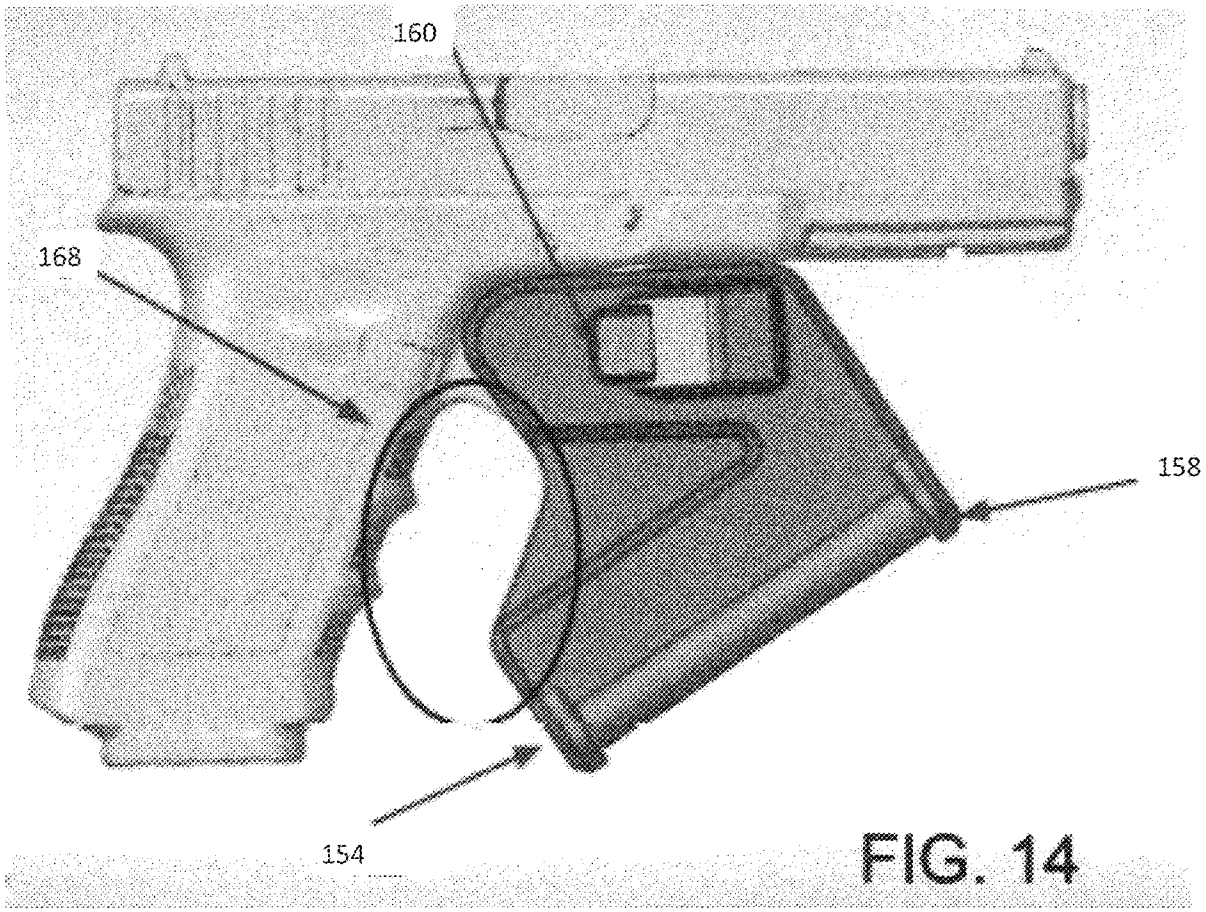
FIG. 14 shows an image of an exemplary embodiment of a locking means for a quick access firearm safety apparatus attached to a firearm, in accordance with an embodiment of the present invention.

FIGS. 12-14 show various views of an embodiment of a quick access firearm safety apparatus 150 and locking mechanism 152 in accordance with embodiments of the present invention. In these figures, a left side ledge for a locking mechanism 152, a key override 154, a rest support for a trigger guard area 156, a gunlock right side 158, a release button 160 including a release button locking latch 162 and a release button torsion spring 164, and a torsion spring for quick release/open 166 are shown. Also, as shown in FIG. 14, an area 168 is shown which is formed when the apparatus is locked onto a firearm, allowing for the apparatus to be disengaged from the firearm with a single hand.

When the firearm safety apparatus 150 is fixed to the firearm, the left side ledge 152 of the lock mechanism extends into the interior of the firearm trigger guard and contacts same. The rest support 156 is in contact with the outside of the firearm trigger guard. The ledge 152 and rest support 156 extend inwardly toward the right side 158 and when closed hold the trigger guard between the ledge 152 and rest support 156 to fix the safety apparatus to a firearm.

FIGS. 12-14 further show that the locking mechanism 152 and the locking latch 162 mate together to secure the firearm safety apparatus 150 in the closed, i.e., locked, position and release when access to the firearm is authorized. The locking knob 156 (or 2301) and rest 152 prevents firearm movement thus preventing access to the firearm trigger; which allows the present safety apparatus to be used with a loaded gun or an unloaded gun. The locking mechanism 152 cantilevers from the inside face of one of the side plates of the apparatus 150. The locking latch 162 is connected to the other side plate of the apparatus 150. The locking latch 162 moves into and out of locking engagement with the locking mechanism 152. The two side plates are connected together along an axis about which at least one of the side plates pivots to release from the gun. In the illustrated example of FIG. 13 the torsion spring 166 is positioned at the axis and in its normal position urges the side plates away from each other. The locking mechanism 152 and locking latch 162, when in the latched position, i.e., engaged position, hold the spring 166 in an energized, i.e., compressed condition. The locking mechanism 152 and locking latch 162 both extend in a non-perpendicular direction relative to the elongate direction of the axis. As shown, the angle of the axis to the length of the locking latch is about 102 degrees. The spring 166 operates to open the safety apparatus 150 when the latch is released using the mechanical energy stored in the spring 166. Thus, the safety apparatus 150 does not consume electrical energy to open the arms or sides of the safety apparatus 150 to access the firearm.

Figure 15:
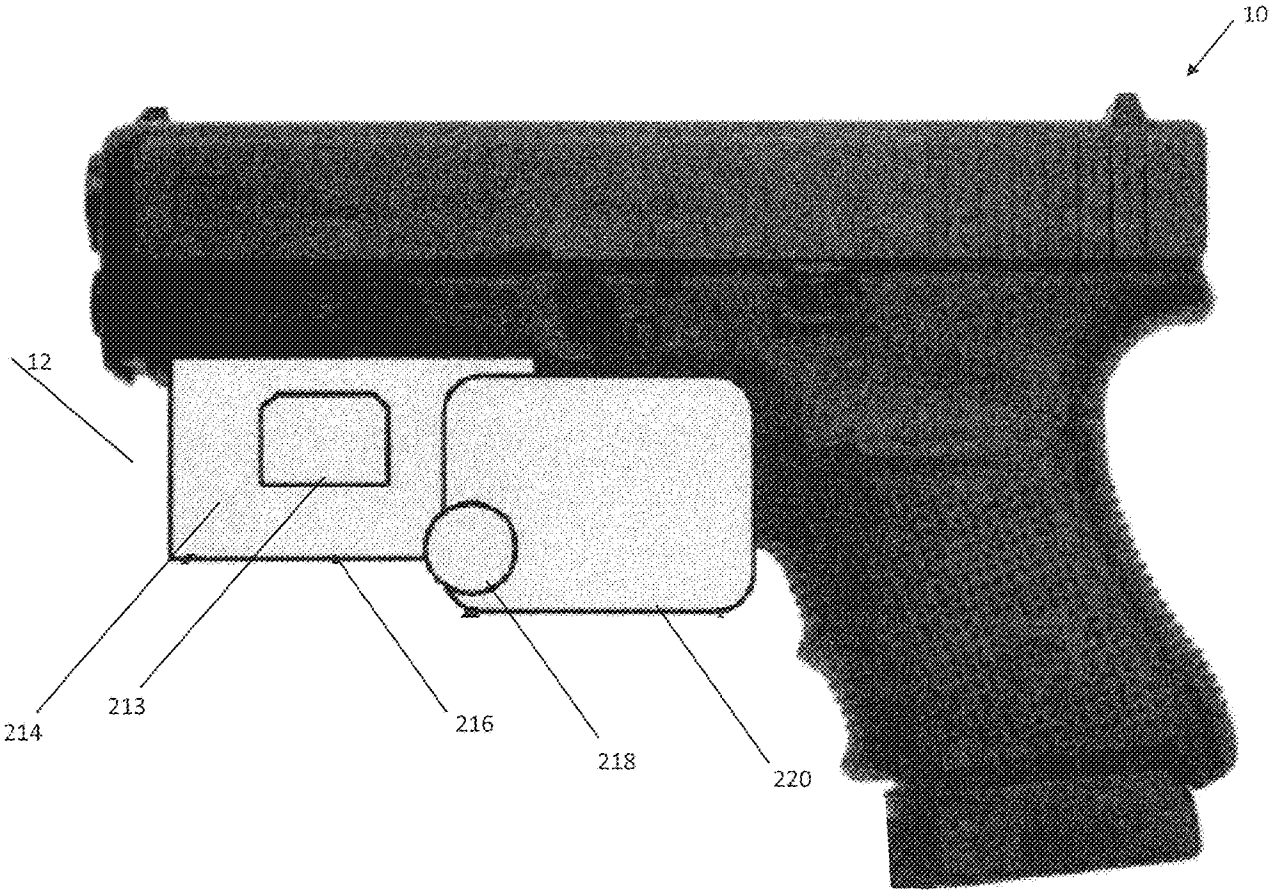
FIG. 15 shows a trigger guard cover that is spring loaded and revolves on a hinge to unlock the trigger according to an embodiment of the invention.

FIG. 15 shows a firearm 10 with a trigger guard cover 220 that is spring loaded and revolves on a hinge 218 to unlock the trigger according to an embodiment of the invention. The safety apparatus housing 216 which is attached to the firearm 10, and onto which the trigger guard 220 pivots when the firearm 10 is in use, and may also house a controller and the hardware for the various access methodologies described above (not shown). Indentation feature 213 is configured to secure an attachment cable (not shown) to secure the firearm 10 to a non-movable object.

Figure 16:
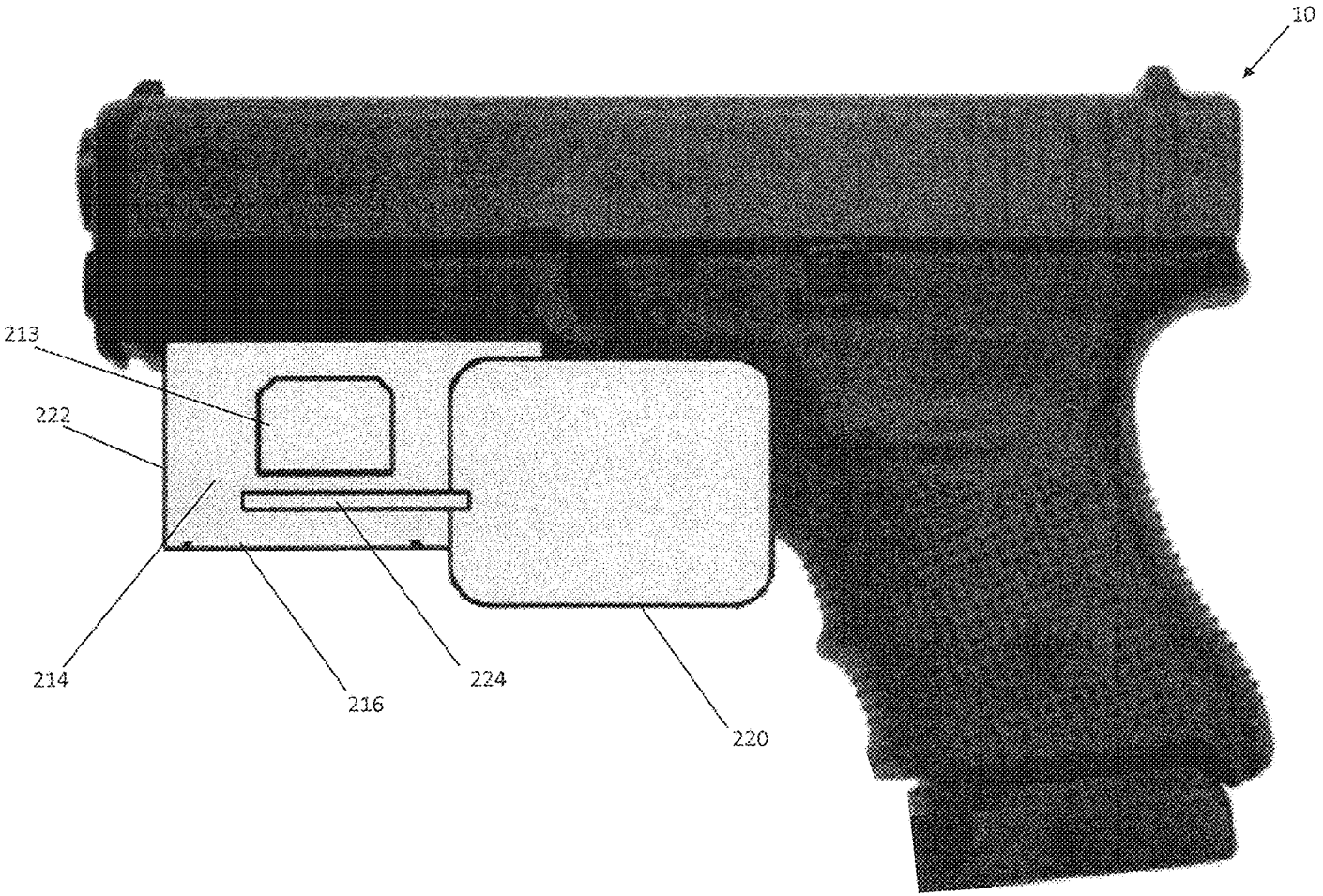
FIG. 16 shows a trigger guard cover that is spring loaded and slides on a guardrail to unlock the trigger according to an embodiment of the invention.
Figure 17:
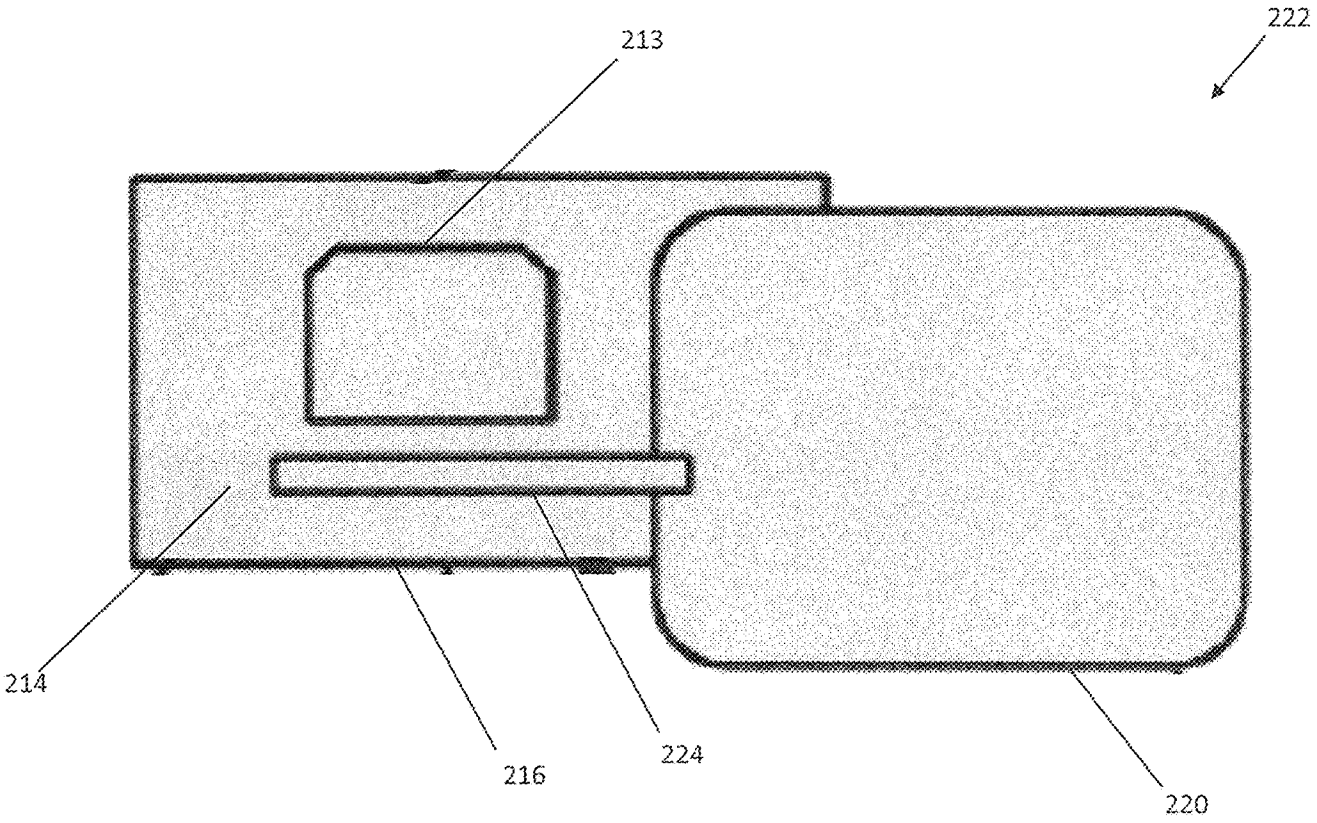
FIG. 17 shows a close-up picture of trigger guard cover of FIG. 16 according to an embodiment of the invention.

FIG. 16 shows a firearm 10 with a trigger guard cover 220 that is spring loaded and slides on a lightrail 224 to unlock the trigger according to an embodiment of the invention. The safety apparatus housing 222 which is attached to the firearm 10, and onto which the trigger guard 220 slides when the firearm 10 is in use, and may also house a controller and the hardware for the various access methodologies described above (not shown). Indentation feature 213 is configured to secure an attachment cable (not shown) to secure the firearm 10 to a non-movable object. FIG. 17 is a close-up picture of trigger guard cover of FIG. 16 dismounted from the firearm 10.

Figure 18:
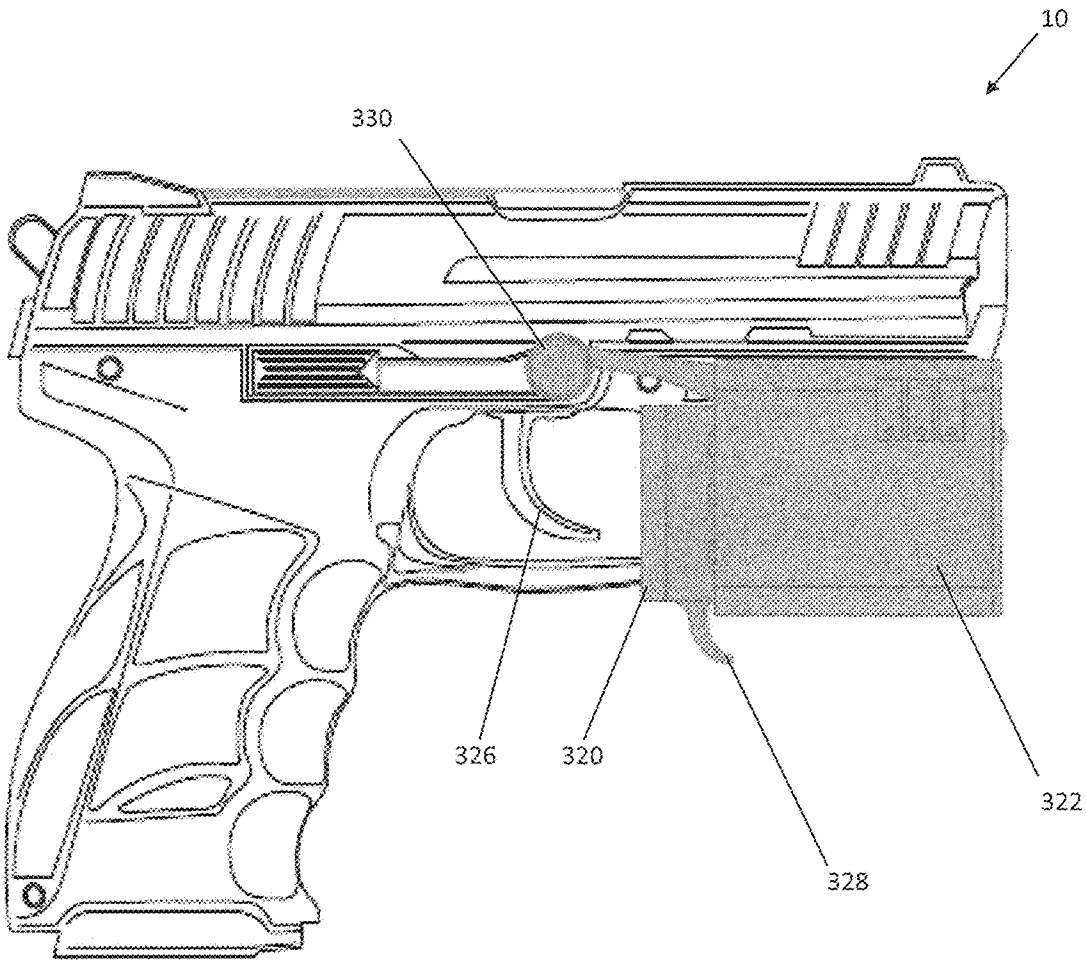
FIG. 18 shows a firearm with a sliding trigger guard cover in a deployed position to access the firearm according to an embodiment of the invention.

FIG. 18 shows a firearm 10 with a sliding trigger guard cover 320 in an opened position to allow access the firearm trigger 326 according to an embodiment of the invention. Biometric fingerprint pad 330 controls access to the firearm 10. The sliding trigger guard cover 320 has a hook protrusion 328 designed to engage a user holster (not shown) when the firearm is placed back into the holster so as to pull the trigger guard cover 320 back over the trigger 326. A custom belt clip for the firearm safety apparatus 322 enables holster-like carrying of an apparatus equipped firearm. A variety of clips can be made available that enable portability, under desk, under steering wheel, etc. For example, such clips can be produced using 3D printing technologies to custom fit a user. A person can be scanned to develop custom inside/outside pants/shirt/ankle clip for firearms equipped with embodiments of the inventive firearm safety apparatus.

Figure 19:
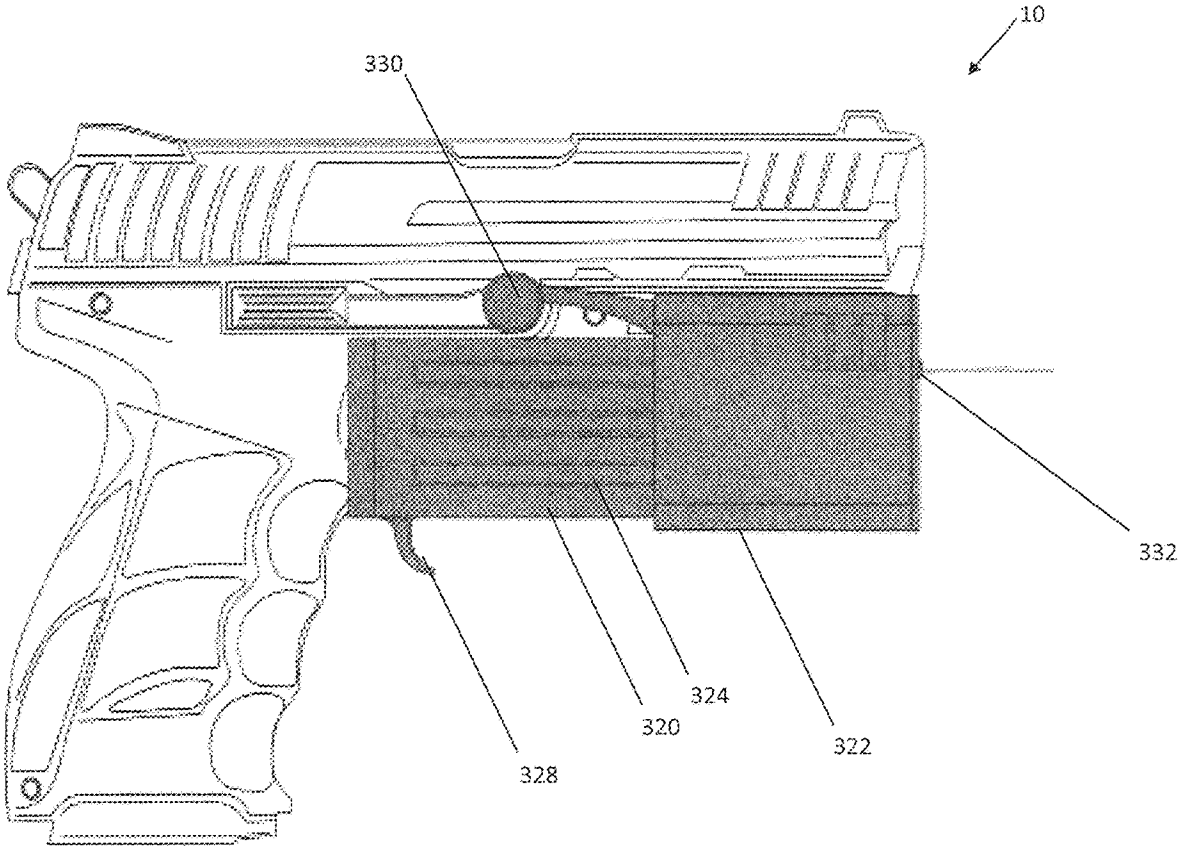
FIG. 19 shows a firearm with a sliding trigger guard cover of FIG. 18 in a closed position that illustrates lighting aspects of the firearm safety apparatus according to an embodiment of the invention.

FIG. 19 shows the firearm 10 with the sliding trigger guard cover 320 on rails 324 of FIG. 18 in a deployed or closed position thereby preventing access to the trigger 326. Biometric fingerprint pad 330 controls access to the firearm 10. Lighting aspects 332 are illustrate by the rays emanating from the front of the of the firearm safety apparatus 322 according to an embodiment of the invention.

Figure 20:
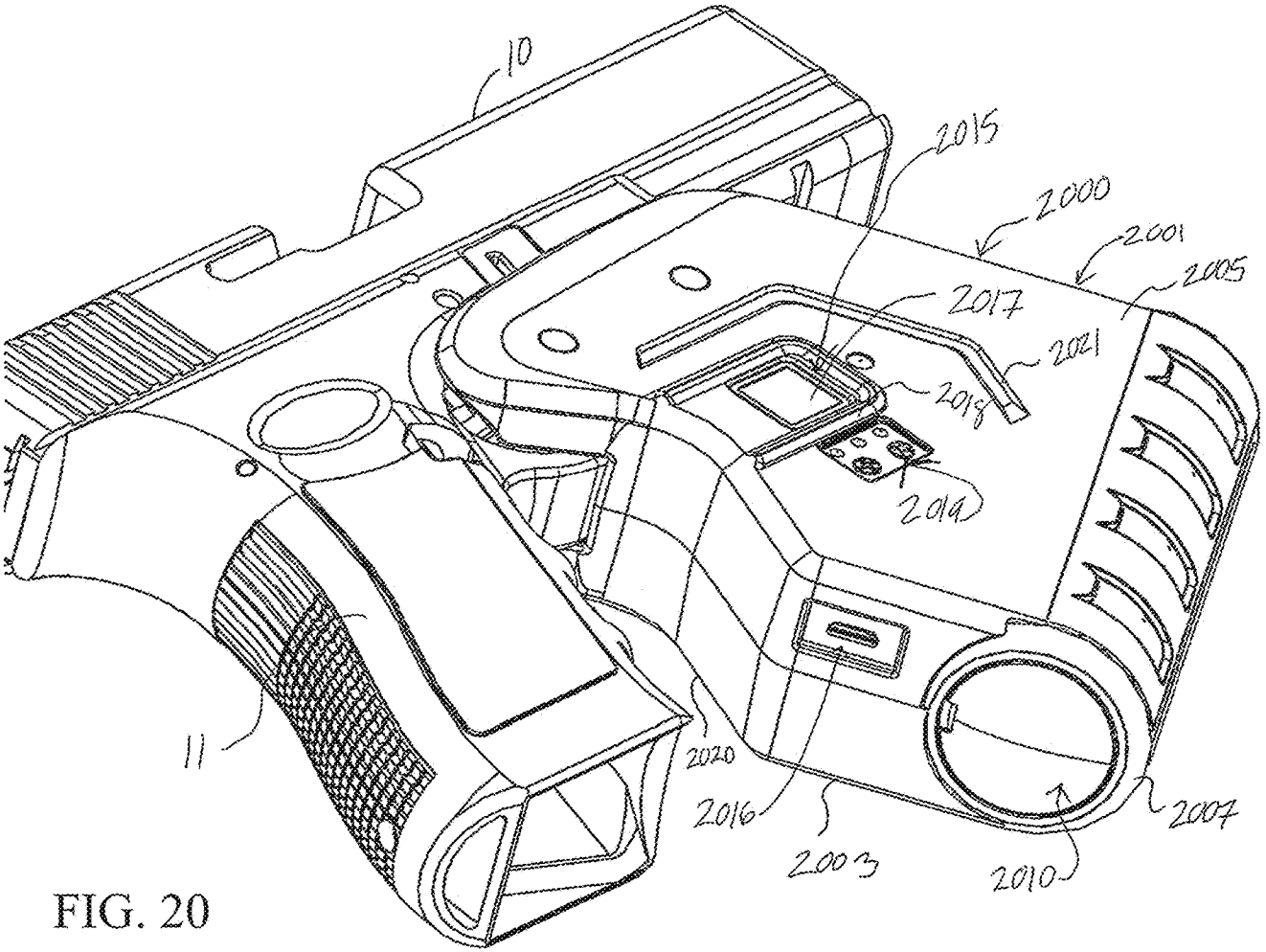
FIG. 20 shows a perspective view of a firearm with a firearm safety apparatus according to an example embodiment.
Figure 21:
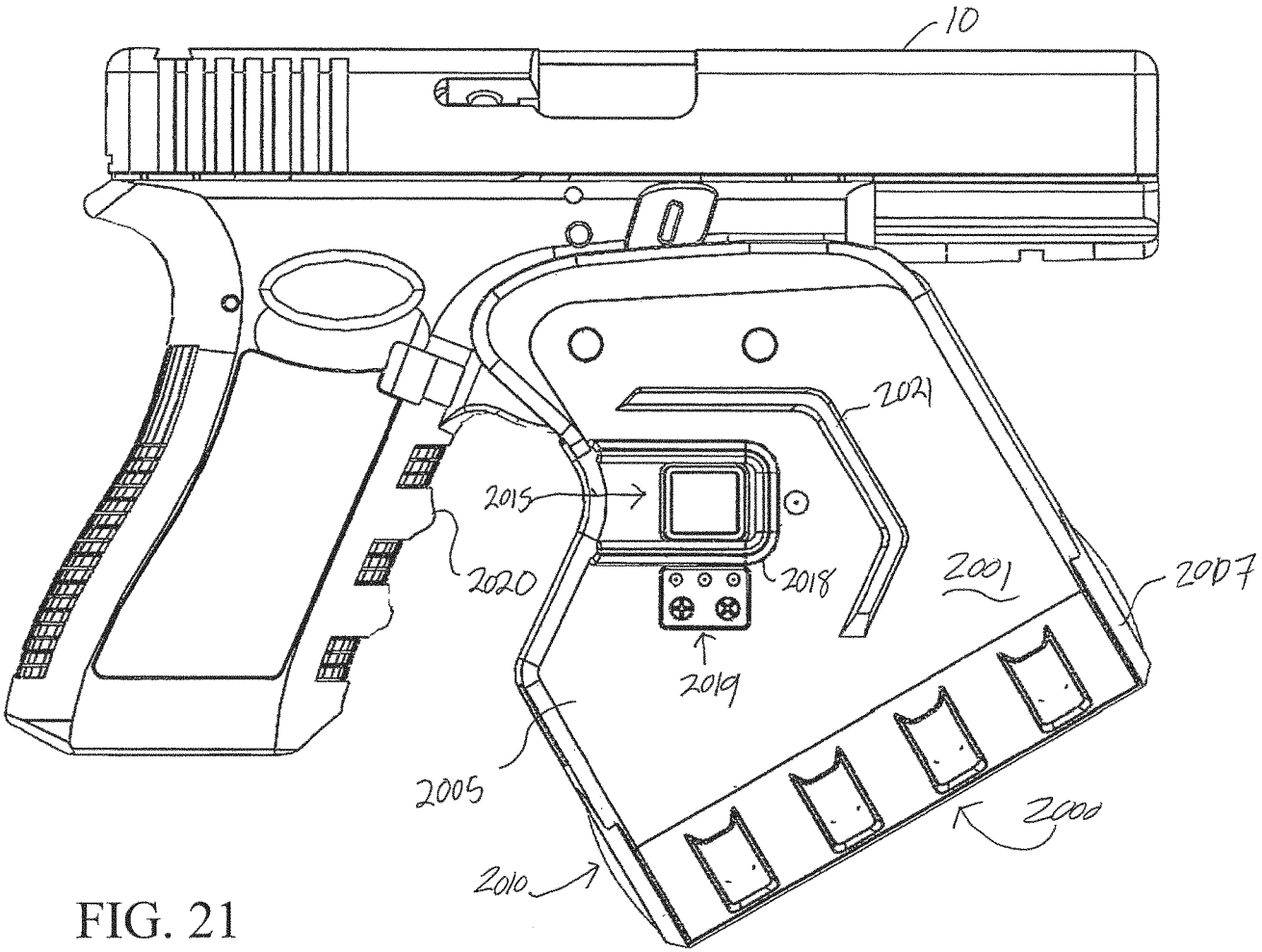
FIG. 21 shows an elevational side view of a firearm with a firearm safety apparatus according to an example embodiment.

FIG. 20 shows a perspective view of a firearm 10 with a firearm safety apparatus 2000 engaged to the firearm to prevent access to the trigger. The firearm safety apparatus 2000 includes an outer housing 2001 with a first side wall 2003 (i.e., a first arm) and a second side wall 2005 (i.e., a second arm) pivotally joined together at joint 2007. The housing 2001 is fabricated from a metal, a high impact polymer, or a laminate to resist forced entry into the firearm safety apparatus 2000 and not break if dropped. The joint 2007 allows the two side walls 2003, 2005 to pivot relative to each other, e.g., up to 30 degrees, up to 20 degrees or up to 10 degrees. The pivot at the joint 2007 allows the side walls 2003, 2005 to move apart at the firearm 10 to release therefrom. The joint 2007 and the side walls 2003, 2005 when closed prevent access to the interior of the firearm safety apparatus 2000 to reduce the likelihood of tampering with the firearm safety apparatus 2000. In FIG. 21, the hinge cover is coated with rubber to decrease impact during a fall or tampering activity. A mechanical lock assembly 2010 is positioned at the joint 2007. The mechanical lock assembly 2010 may act to mechanically unlock and release the firearm safety apparatus 2000 as described in greater detail herein. An electrical lock assembly 2015 is positioned in the housing 2001 and can operate to electronically open the firearm safety apparatus 2000. The electrical lock assembly 2015 does not need the mechanical lock assembly 2010 to open the firearm safety apparatus 2000. The mechanical lock assembly 2010 may operate as a backup or override to the electrical lock assembly 2015. An electrical port 2016 is provided to allow electrical communication to the electronic system in the housing 2001. The electrical port 2016 can be a standardized connector, e.g., a serial port, a universal serial bus port, IEEE 1994 port, PS/2 port, Ethernet port and the like. The port 2016 can be used to charge a battery in the housing 2001. In an example, the port 2016 can be used to communicate with external electronic systems to upload new software, or download fingerprint images of users to identify unauthorized user.

The electrical lock assembly 2015 includes a biometric sensor 2017 that can wake the electronics internal to the housing 2001 and identify the user attempting to release the firearm safety apparatus 2000 as authorized and unlock or not authorized and stay locked. A ridge 2018 is adjacent the biometric sensor 2017 to guide the user's to the sensor 2017. In the illustrated example, the ridge 2018 extends along the bottom, far end and top of the sensor 2017. The user can tactilely identify the location of the biometric sensor 2017. In other examples, the ridge 2018 may be only along one or two sides of the sensor 2017. The ridge 2017 may also be inverted into a valley into the side wall 2005 that performs the same function to assist the user in locating the sensor 2017. A secondary ridge 2021 is provided on the side wall 2005 outwardly from the sensor 2017 and ridge 2018. This secondary ridge 2021 may provide a further guide to the user to find the sensor 2017 by feel and not require the user to visually find the sensor 2017.

The sensor 2017 may include a mechanical switch that when depressed activates, e.g., wakes, the circuitry and processor in the firearm safety apparatus 2000. The circuitry and processor are part of the electrical lock assembly 2015. Inputs 2019, e.g., switches or buttons, are provided to allow a user to program the firearm safety apparatus 2000, particularly, the electrical lock assembly 2015. In an example, a plurality of biometric signatures can be stored in the electrical lock assembly 2015 with the apparatus 2000 being open and a certain button sequence being pressed and then the user presses a finger on the sensor 2017. Lights, e.g., LEDs, can be provided with the inputs 2019 to provide information to the user regarding the status of the programming and the apparatus 2000 as a whole.

The housing 2001 is shaped such that is can engage the firearm 10, e.g., by engaging the trigger guard and rail, or barrel, to cover the trigger while leaving space 2020 between the housing 2001 and grip 11. Accordingly, a user can hold the grip 11 as a normal with the user's fingers extending into the space 2020. In this example, the user will also have access to the magazine, which can be placed in the grip 11.

FIG. 21 shows an elevational side view of the firearm 10 with a firearm safety apparatus 2000 engaged to the firearm to prevent access to the trigger. As shown, the user can hold the grip 11 with the user's fingers extending into the space and a single finger can extend forwardly to engage the electronic lock 2015. e.g., at the biometric sensor. The sensor 2017 in an embodiment may be positioned slightly lower than the trigger area so upon the apparatus 2000 being unlocked, the likelihood of the user unintentionally engaging the trigger is reduced. That is, the sensor is positioned below the trigger arm guard when the safety apparatus is mounted to the firearm. In an example, the biometric sensor 2017 is a fingerprint sensor. The fingerprint sensor 2017 can be a pressure sensor that has sufficient resolution to take an accurate image of the user's finger on the sensor and output an electrical image signal of the fingerprint to send to a processor to compare to a stored fingerprint image or to multiple stored fingerprint images. The fingerprint sensor can be an optical device used to capture impressions digitally. The fingerprint sensor may have sufficient resolution to provide at least an 8 point match, or preferably, greater than an 8 point match, e.g., 12, 14, 16, or 18 point match.

Figure 22:
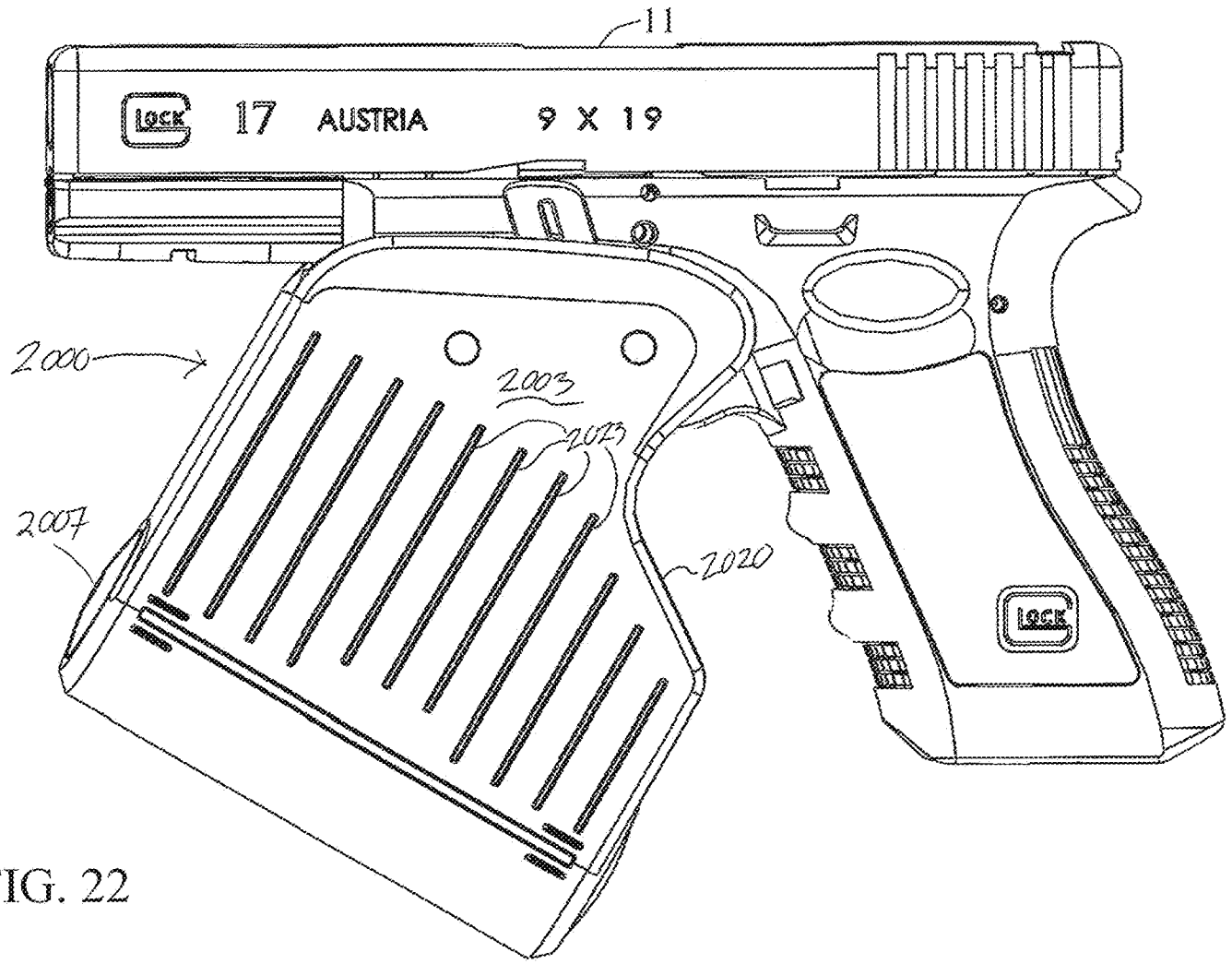
FIG. 22 shows an elevational view of a side opposite the FIG. 21 view.

FIG. 22 shows an elevational view of a side opposite the FIG. 21 view. The side wall 2003 may include a plurality of striae 2023. The staie 2023 will indicate to a user that the sensor is not on this side of the firearm safety apparatus 2000. The staie 2023 may include a plurality of equally spaced ridges that are on the outer surface of the side wall 2003.

Figure 23:
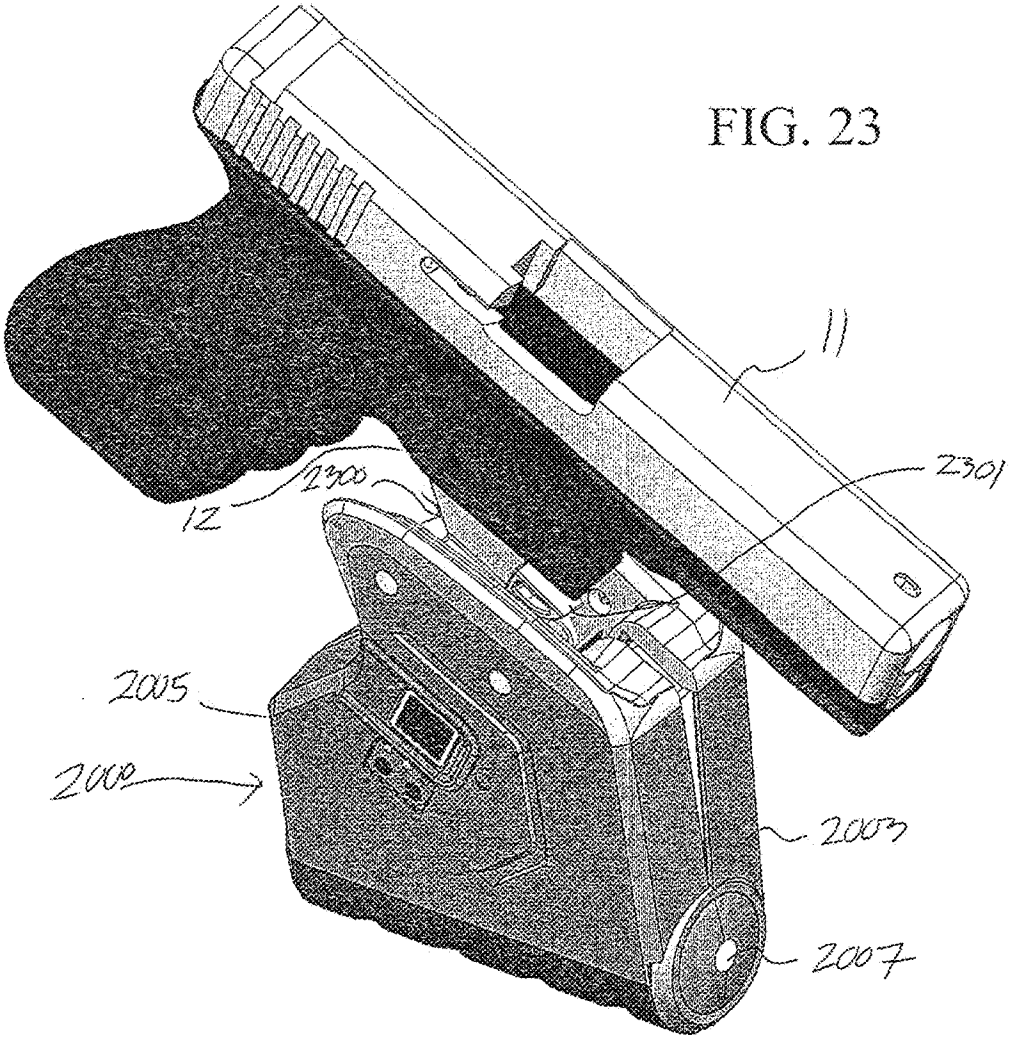
FIG. 23 shows a view of a firearm and a firearm safety apparatus according to an example embodiment.

FIG. 23 shows the firearm safety apparatus 2000 open and falling away from the trigger guard 12. The side walls 2003, 2005 can be biased away from each other such that unlocking by one of the mechanical lock apparatus 2010 or the electronic lock apparatus 2015 allows the side walls to move away from each other such that the locking protrusion (e.g., a knob) 2301 moves from inside the trigger guard, in front of the trigger, to allow the firearm safety apparatus 2000 to fall free from the firearm 10. In an example, the opening of the sidewalls 2003, 2005 is about 10 degrees, +/−1 degree or +/−3 degrees. In an example, the opening can be up to about 15 degrees or up to about 20 degrees +/−1 degree or +/−3 degrees. The locking protrusion 2301 is only on one side wall, here, shown as side wall 2003. This promotes the ease of the safety apparatus opening and falling away from the firearm. In an example, the locking protrusion 2301 may be the same as the locking mechanism left side ledge 152 (FIGS. 12-14). In an embodiment the locking protrusion 2301 (or 156) is adjustable to allow the safety apparatus to be universal.

Figure 24:
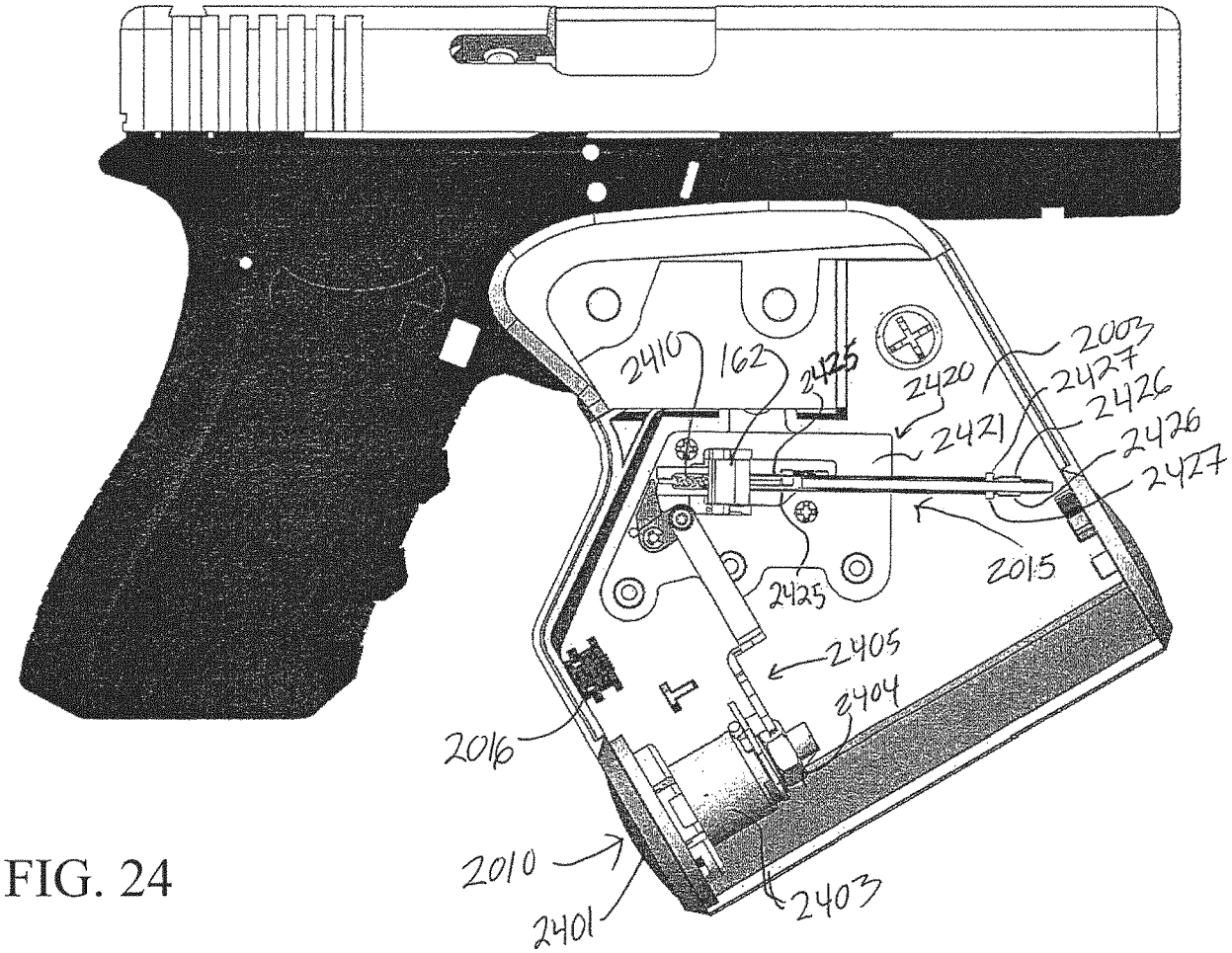
FIG. 24 shows a view of the firearm and an open view of the firearm safety apparatus with the biometric sensor supporting side wall removed for ease of illustration.

FIG. 24 shows a view of the firearm 11 and an open view of the firearm safety apparatus 2000 with the biometric sensor supporting side wall 2005 removed for ease of illustration. The latch mechanism 2420 includes a plate 2421 that is fixed to the side wall 2003. The latch 162 is moveably supported on the plate 2421 so that the latch can move to engage to and disengage from the mating member of the other side wall 2005 (not shown in FIG. 24). The latch 162 can be urged to an engaging, i.e., closed, position by mechanical means, e.g., a spring 2410. Both the mechanical lock assembly 2010 and the electrical lock assembly 2015 can engage the latch 162 to unlock the firearm safety apparatus 2000.

The mechanical lock assembly 2010 includes a key entry 2401 into a key cylinder 2403, which is mounted in the housing 2001, e.g., at the joint 2007 and, in an example, collinear with the pivot axis of the two sides 2003, 2005. In an example, the lock cylinder is tumbler or pin tumbler that when engaged by a matching key (not shown), allows a plug 2404 to rotate. A mechanical linkage 2405 is connected between the plug and the moveable latch 162 such that when the key turns the plug 2404, the linkage 2405 translates the rotational movement of the plug 2404 to linear movement of the latch 162 to disengage (i.e., unlock) the two side walls 2003, 2005 from each other. As shown, the latch is essentially perpendicular to the gun barrel and at an angle with respect to the pivot axis of the two side walls 2003, 2005. In an example, the angle is about 55 degrees, +/−2 degrees. In an example, the angle is about 58 degrees. In an example, the angle is less than 65 degrees. In an example, the angle is in a range of about 50−60 degrees, +/−2 degrees or an upper limit of about 65 degrees. By placing the latch 162 at an angle relative to pivot axis, the force needed to open the firearm safety apparatus 2000 is reduced relative to the latch 172 being perpendicular or parallel to the pivot axis. The reduction of the force necessary to open the latch 162 can result in reduced electrical power consumption when using the electrical lock assembly 2015.

The electrical lock assembly 2015 is partially shown in FIG. 24 and includes electrically activated means to move the latch to the open position when a biometric signature indicates that an authorized user is identified, e.g., by a processor 2430 (FIG. 25) confirming the fingerprint at the sensor 2017 matches a stored fingerprint. In an example, the electrical lock assembly 2015 includes at least one shape memory alloy wire 2425 that has a fixed at a mount point 2426 remote from the latch 162. The wire 2425 is connected at its other end to the latch 162. The wire 2425 is actuatable by an electrical signal applied thereto, which will cause the wire to retract and pull the latch 162 open. In an example, the electrical signal heats the wire and the wire moves to the refracted position. In an example, the wire is a nickel titanium alloy or a copper-aluminum-nickel alloy. The wire can be a one-way shape memory alloy. The electrical signal is triggered from a processor indicating that a signature match has occurred.

In an example, the wire 2425 can be positioned below a pivot axis of the latch 162 to move the latch against the urging of a biasing spring to an open position, i.e. the latch disengaged from a catch on the other wall. The linkage of the mechanical lock 2010 can be positioned below the pivot axis on the other side of the latch to push the latch top the open position against the bias of the spring. Thus, both the mechanical lock and the wire move the latch to the open position.

Figure 25:
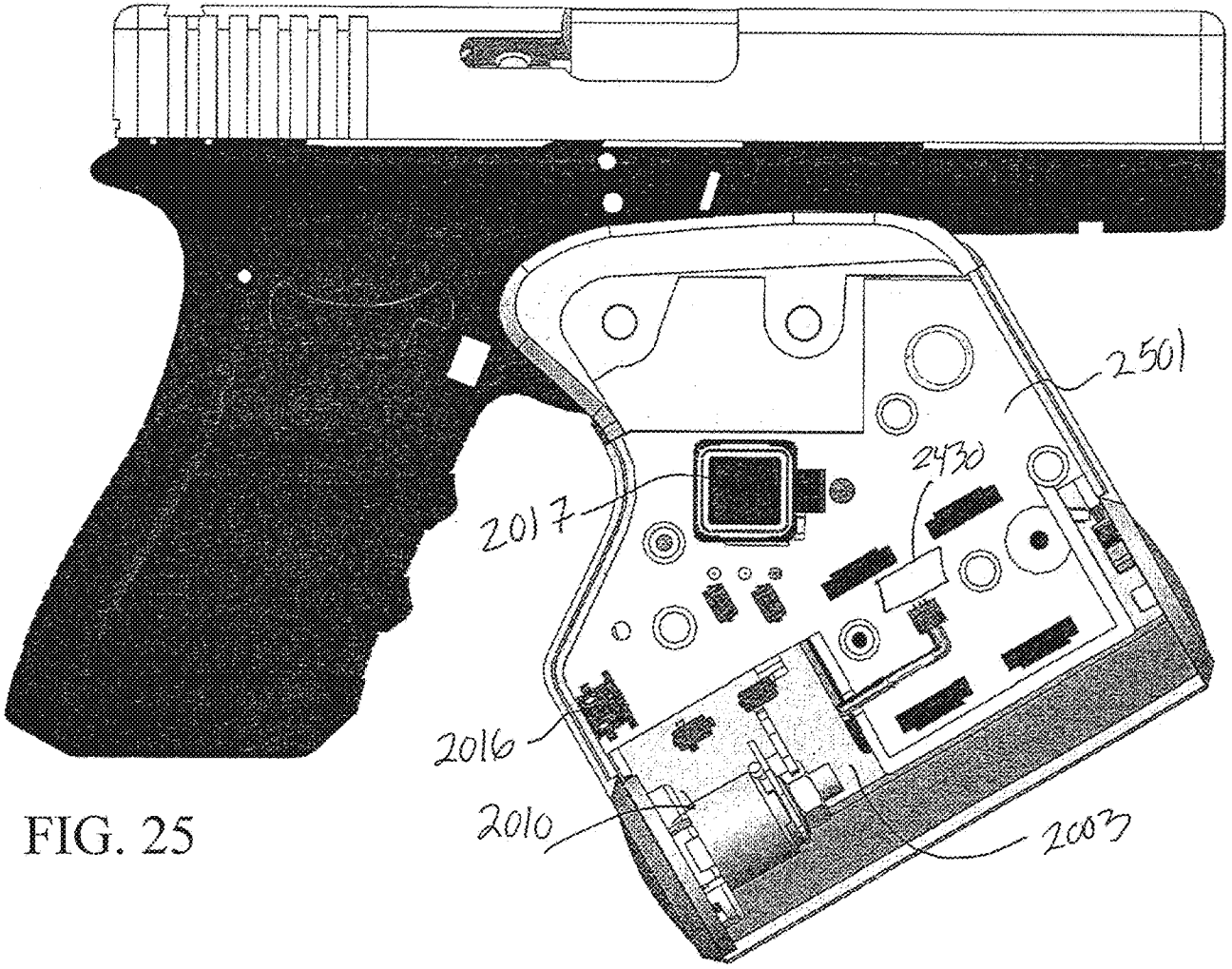
FIG. 25 shows a view of the firearm and an open view of the firearm safety apparatus with a biometric sensor supporting side wall removed for ease of illustration.

FIG. 25 shows a view of the firearm 11 and an open view of the firearm safety apparatus 2000 with the biometric sensor supporting side wall 2005 removed for ease of illustration. A support structure 2501 is mounted in the housing 2001, on either the side wall 2003 or the side wall 2005. The supporting structure 2501 is provided to support the electronics of the electronic lock assembly 2015, including but not limited to a memory (preferably, a non-volatile memory), a processor, the biometric sensor 2017, a battery (preferably, a rechargeable battery), a processor to execute instructions to match sensed biometric data to stored biometric data, and other circuit components. The support structure 2501 may be printed circuit board or other electrically neutral structure, e.g., a glass laminate.

Figure 26:
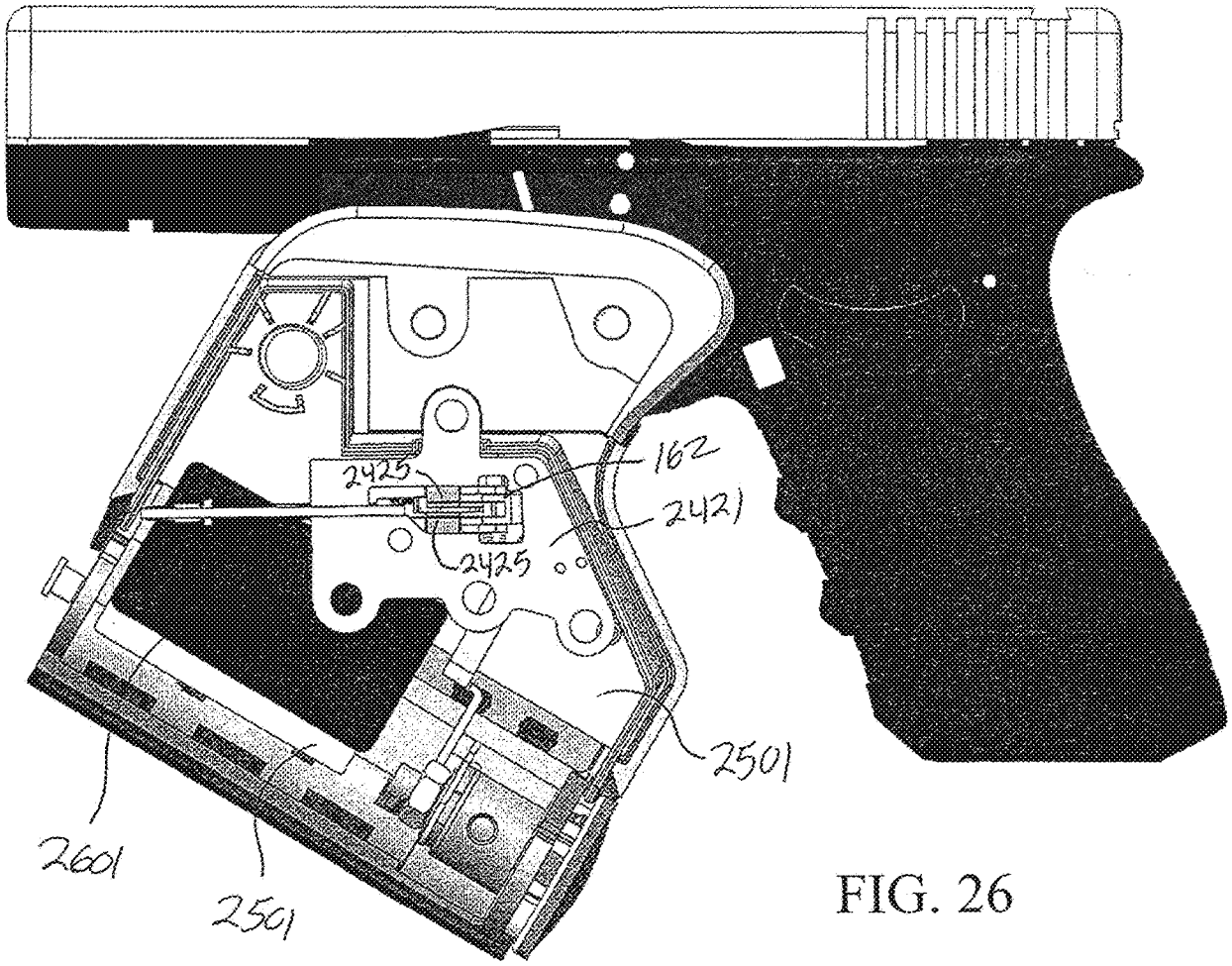
FIG. 26 shows a view of the firearm and an open view of the firearm safety apparatus with a side wall removed for ease of illustration.

FIG. 26 shows a view of the firearm 11 and an open view of the firearm safety apparatus 2000 with the side wall 2003 and the removed for ease of illustration. A battery 2601 is mounted to the support structure 2501. Wiring can connect the battery 2601 to the processor and circuitry to activate the electronic lock assembly. The battery 2601 may also power the sensor 2017. In an example, the battery 2601 is rechargeable through the port 2016.

Figure 27:
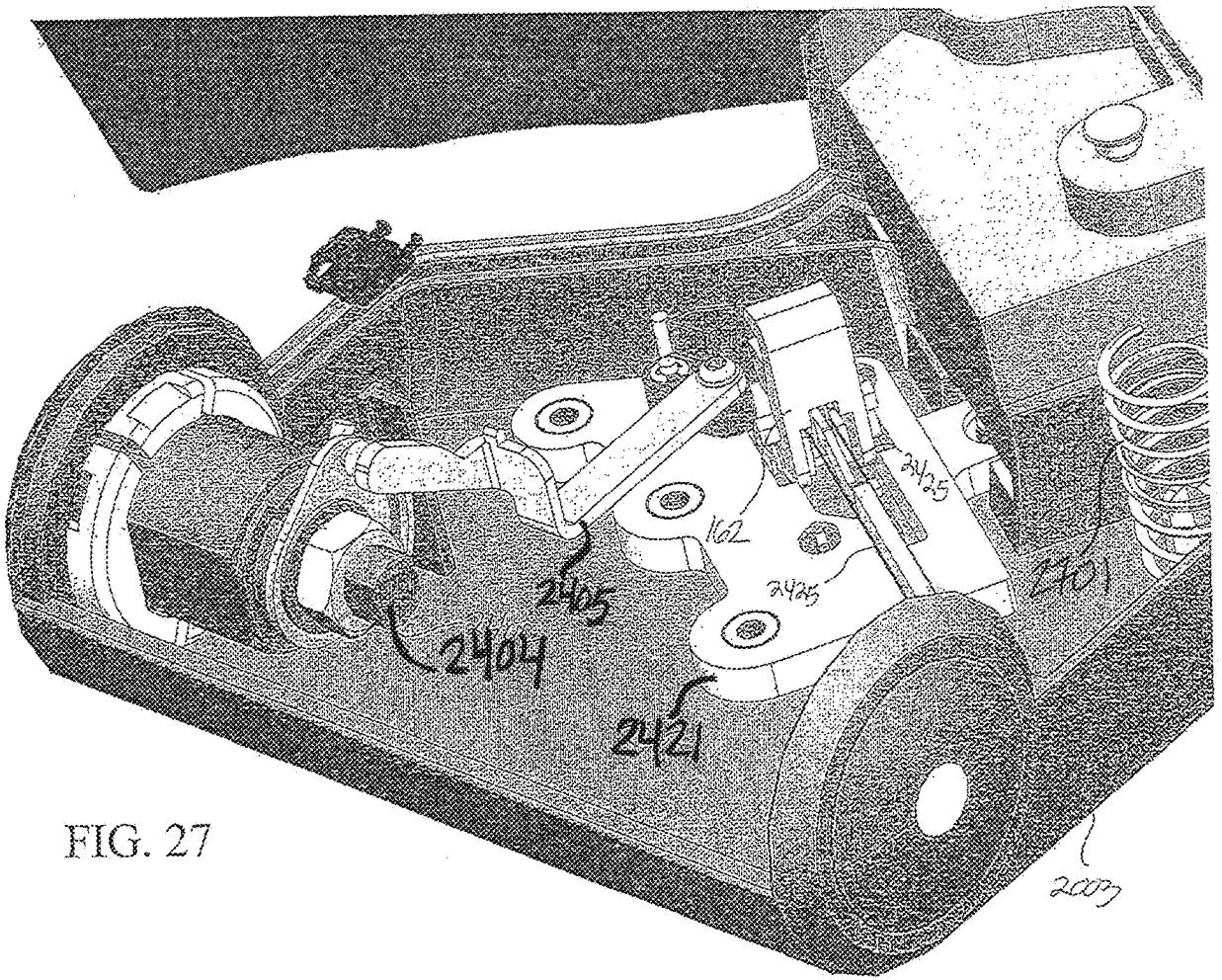
FIG. 27 shows an enlarged, partial view of a firearm safety apparatus with a side wall removed for ease of illustration.

FIG. 27 is an enlarged view of an open view of the firearm safety apparatus 2000 with the biometric sensor supporting side wall 2005 removed for ease of illustration according to an example embodiment. A spring 2701 is provided to urge the two side walls 2003 and 2005 apart. The latch 162 holds the sides 2003, 2005 together against the urging of the spring 2701.

Figure 28:
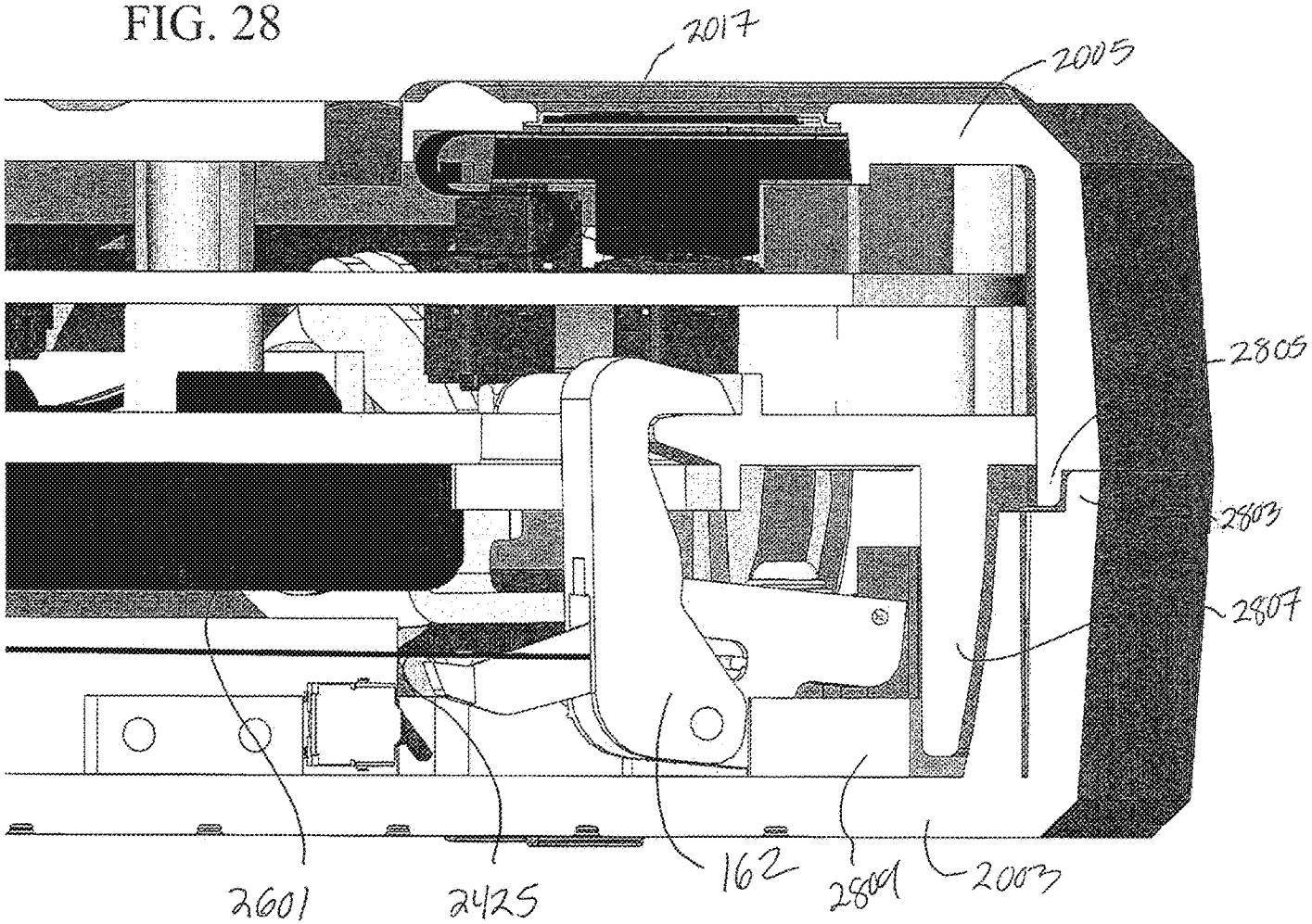
FIG. 28 is an enlarged, partial view of a closed firearm safety apparatus according to an example embodiment.

FIG. 28 is an enlarged, partial view of a closed firearm safety apparatus 2000 according to an example embodiment. The side wall 2003 includes a lip 2803. The side wall 2005 includes a lip 2805 that overlaps the lip 2803. The overlapping lips 28003, 28005 act to prevent access to the interior of the housing 2001. The side wall 2005 further supports an arm 2807 that extends downwardly past the joint defined by the lips 2803, 2805 to further prevent access between the lips 2803, 2805 to the latch 162. A block 2809 acts to support the latch 162 and further block access past the arm 2807. Thus, access from the outside to the latch is through a serpentine route with a plurality of turns to reduce the likelihood of of an unauthorized user prying open the side walls 2003, 2005 and access the latch 162. The latch 162 is cantilevers inwardly from the side of the wall 2003 from a pivot axis. The free end of the latch 162 extends at an angle relative to the body of the latch 162 toward the arm 2807, which can be integrally formed with a catch to receive the latch free end. When the latch 162 pivots away from the arm 2807, the catch is released and the side wall 2005 moves away from the side wall 2003 containing the latch 162. The catch may also include blocking members adjacent a latch receiving lip with the blocking members extending upwardly and downwardly relative to the latch receiving lip. Thus safety apparatus includes additional safety structures to prevent access to the latch if the lips 2803, 2805 and the arm 2807 are bypassed.

Figure 29:
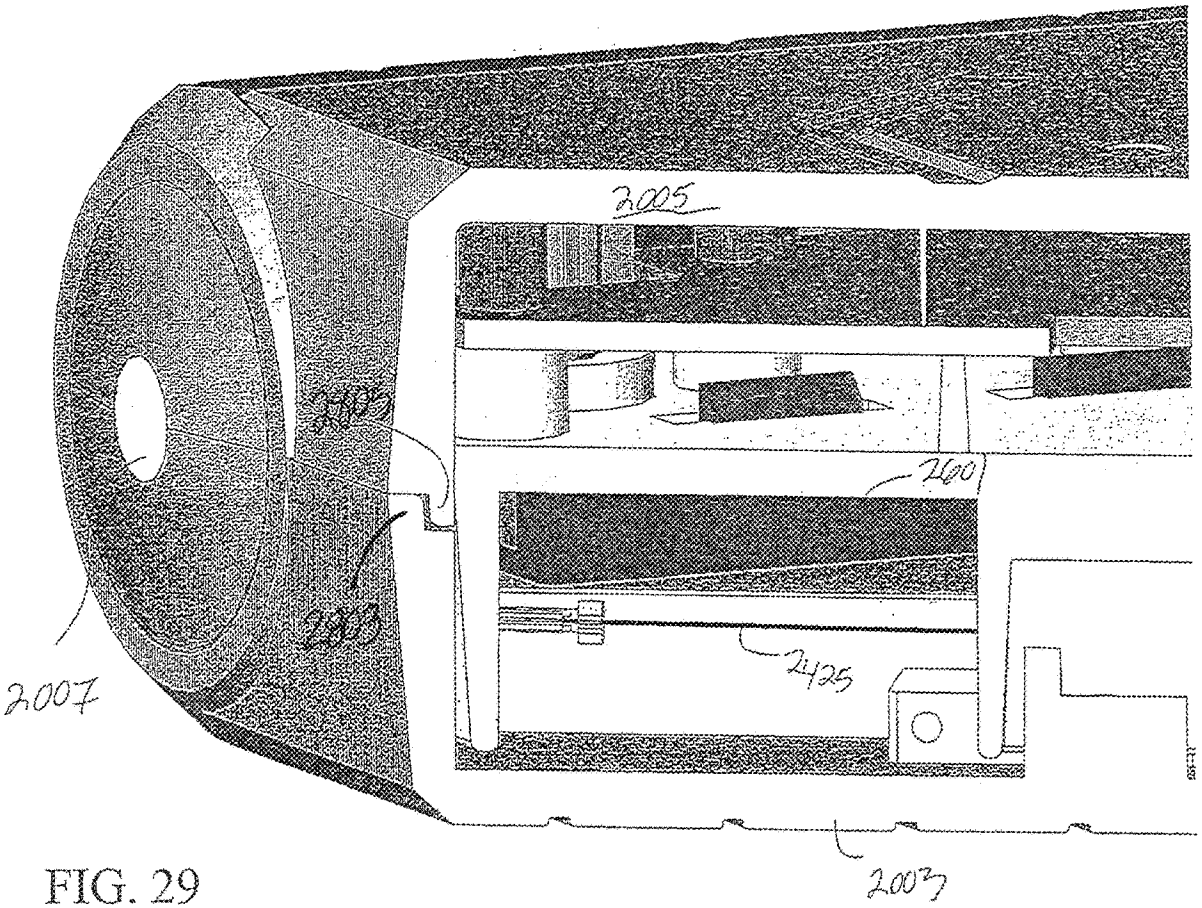
FIG. 29 is an enlarged, partial view of a closed firearm safety apparatus according to an example embodiment.

FIG. 29 is an enlarged, partial view of a closed firearm safety apparatus 2000 according to an example embodiment. This view is similar to FIG. 28 but adjacent the joint 2007.

Figure 30:
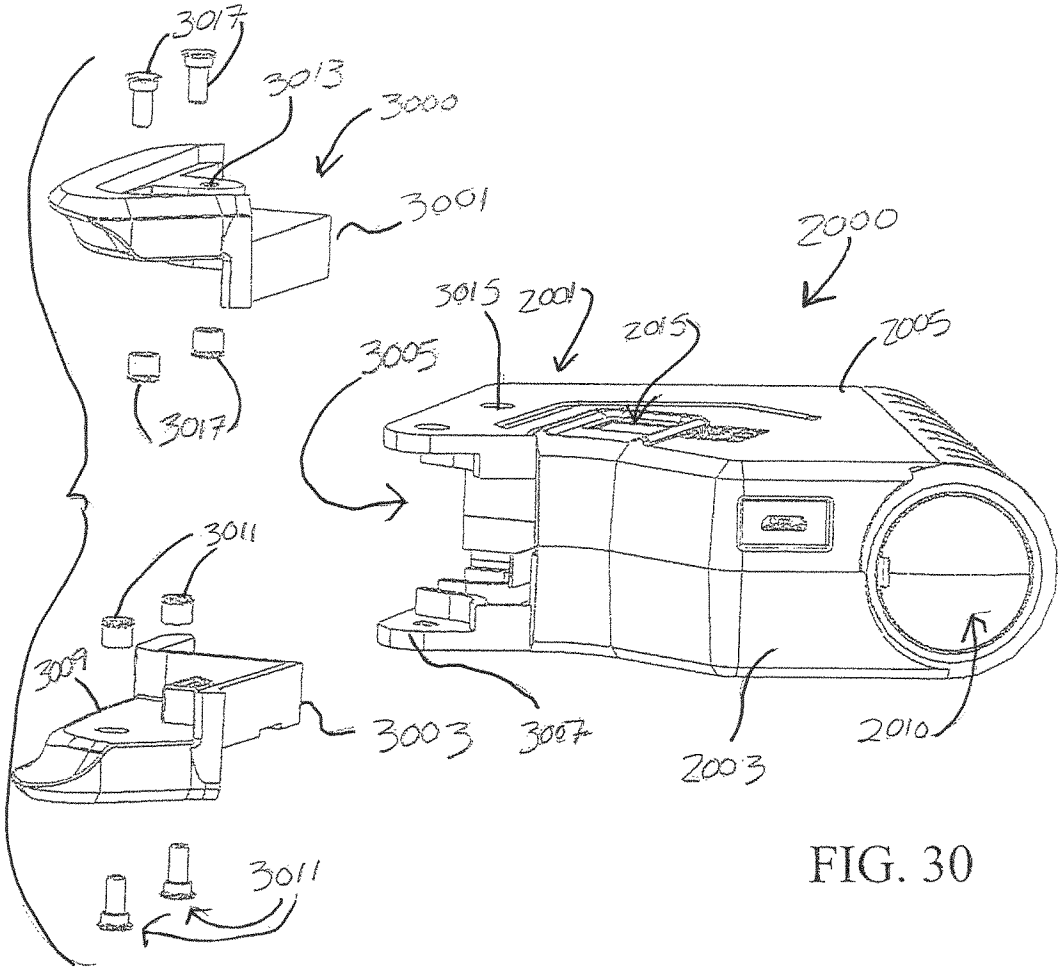
FIG. 30 shows a perspective view of a firearm safety apparatus according to an example embodiment.

FIG. 30 is a perspective view of a closed firearm safety apparatus 2000 according to an example embodiment with an adaptor 3000. The adaptor 3000 allows the firearm safety apparatus 2000 to be adapted to different types of firearms and different shapes of firearm guards. The adaptor 3000 includes a first adaptor 3001 and a second adaptor 3002 that are respectively received in the side walls 2005, 2003 to alter the configuration of firearm engaging opening 3005 of the housing 2001. The side wall 2003 includes apertures 3007 at the opening 3005. The adapter 3003 can have a first side that engages the wall 2003 and aligns adapter apertures 3009 to the side wall apertures 3007. A fastener 3011 can be inserted in each pair of the aligned apertures 3007, 3009 to fix the adapter 3003 in the bottom half of the opening 3005. The second side of the adapter 3003 defines a side of newly shaped apparatus opening 3005. The adapter 3001 can have a first side that engages the wall 2005 and aligns adapter apertures 3013 to the side wall apertures 3015. A fastener 3017 can be inserted in each of the aligned pairs of apertures 3013, 3015 to fix the adapter 3001 in the top half of the opening 3005. The second side of the adapter 3001 defines a side of newly shaped apparatus opening 3005. The apparatus 2000 with the adapters 3001, 3003 can operate the same as described herein with regard to just the apparatus with a differently shaped opening 3005 to receive the firearm and restrict access thereto.

The present device may store fingerprint files in a memory. As users have different fingerprints, the present apparatus must provide for programming. In an example, the mechanical lock must be moved to a programming position, e.g., an unlock position to allow the user to program their user's fingerprint into the circuitry. In an example, the mechanical lock is moved to a programming position, which can be sensed internally in the housing, e.g., by position of the key tumbler, the linkage or other connected sensed parts. The user may also need to press a sequence in the buttons or activate switches at the input 2019. Thus user then presses a finger on the fingerprint sensor 2015. The circuitry stores the sensed fingerprint in the memory.

Figure 31:
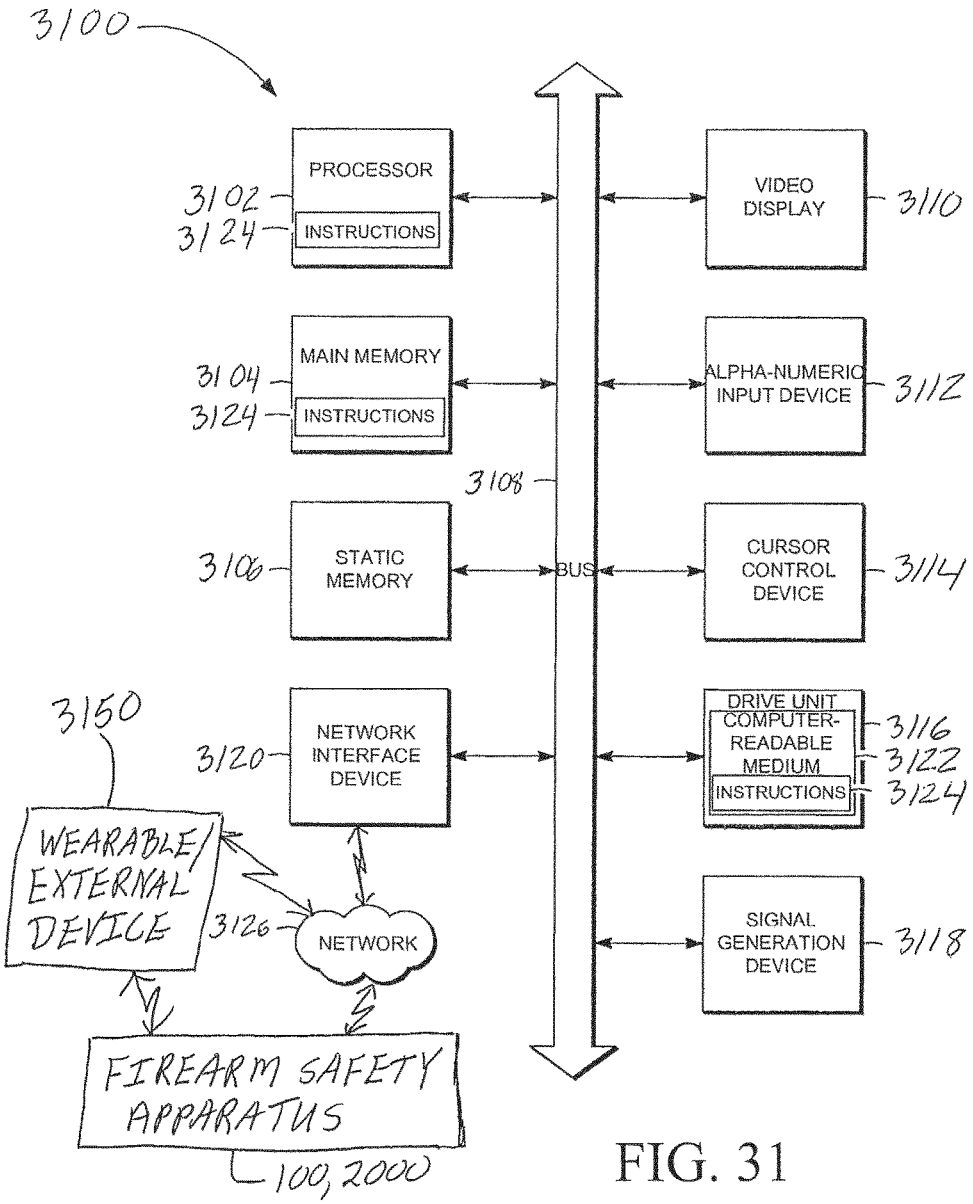
FIG. 31 is a system according to an example embodiment.

FIG. 31 shows a block diagram of a machine in the example form of a computer system 3100 within which a set of instructions may be executed causing the machine to perform any one or more of the methods, processes, operations, or methodologies discussed herein.

In an example embodiment, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. The machine may be a server computer, a client computer, a personal computer (PC), a tablet PC, a gaming device, a set-top box (STB), a Personal Digital Assistant (PDA), a cellular telephone, a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 3100 includes a processor 3102 (e.g., a central processing unit (CPU) a graphics processing unit (GPU) or both), a main memory 3104 and a static memory 3106, which communicate with each other via a bus 31031. The computer system 3100 further includes a video display unit 3110 (e.g., a liquid crystal display (LCD) or a cathode ray tube (CRT)). The computer system 3100 also includes an alphanumeric input device 3112 (e.g., a keyboard), a cursor control device 3114 (e.g., a mouse), a drive unit 3116, a signal generation device 3118 (e.g., a speaker) and a network interface device 3120. The network interface 3120 may communicate with the firearm safety apparatus and/or home security 100, 2000 through a network 3126.

The drive unit 3116 includes a computer-readable medium 3122 on which is stored one or more sets of instructions (e.g., software 3124) embodying any one or more of the methodologies or functions described herein. The software 3124 may also reside, completely or at least partially, within the main memory 3104 and/or within the processor 3102 during execution thereof by the computer system 3100, the main memory 3104 and the processor 3102 also constituting computer-readable media. The software 3124 may further be transmitted or received over a network 3126 via the network interface device 3120. The drive unit and memory may store instructions for operating the firearm safety apparatus 100, 2000 remotely from the apparatus 100, 2000.

While the computer-readable medium 3122 is shown in an example embodiment to be a single medium, the term "computer-readable medium" should be taken to include a single medium or multiple media (e.g., a centralized or distributed database, and/or associated caches and servers) that store the one or more sets of instructions. The term "computer-readable medium" shall also be taken to include any medium that is capable of storing or encoding a set of instructions for execution by the machine and that cause the machine to perform any one or more of the methodologies of the present invention. The term "computer-readable medium" shall accordingly be taken to include, but not be limited to, solid-state memories, optical media, and magnetic media. In some embodiments, the computer-readable medium is a non-transitory computer-readable medium.

In an another example a push button with mechanical switch wakes up electronics of the firearm safety apparatus, which then use wireless communication like RFID, NFC, Wi-Fi or others to unlock device remotely. In another example a wireless signal unlocks device remotely. In an example, the wireless signal is received at the firearm safety device and when the user presses a button or selects a switch the firearm safety apparatus is opened and allows access to the firearm.

In a further example, an external electronic device 3150, e.g., a wearable, a bracelet, a watch, a personal data assistant, a ring, a mobile phone, key fob or other portable electronic device, stores a token that must be adjacent the firearm safety device to provide a security code to unlock the safety apparatus or allow the safety apparatus to wake up and sense a finger print using the sensor. The external device may be a home security system that automatically unlocks the safety apparatus when instructed by the home security system. The home security system may include at least some of the computer components described with regard to FIG. 31 below, along with intrusion sensors. The device 3150 communicates the security code directly to the safety apparatus, e.g. through a short range communication, or through the network 3126 to the safety apparatus.

Figure 32:
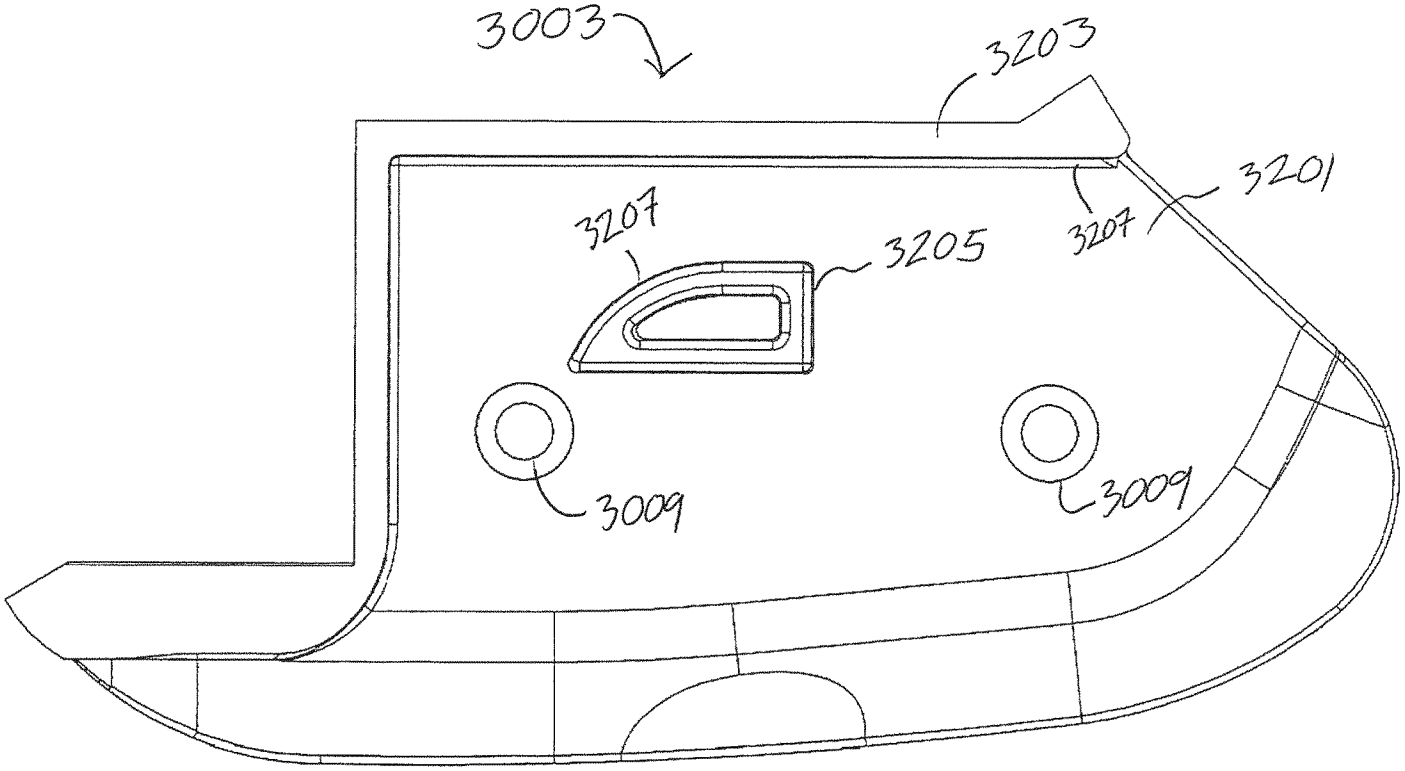
FIG. 32 is an enlarged view of an insert for a firearm safety apparatus according to an example embodiment.

FIG. 32 shows an enlarged side view of an adapter 3003 that can be inserted into the side wall 2003 to alter the profile of the portion of the firearm safety apparatus 2000. The adapter 3003 includes a solid rear plate 3201 in which the apertures 3009 are formed. An outer wall 3203 extends at an angle relative to the rear plate 3201 and is adapted to extend along the outer contour of the trigger guard when engaged on a firearm 11. A protrusion (e.g., a knob) 3205 extends in the same direction as the outer wall 3203 such that they both engage the fire arm trigger guard to secure the safety apparatus 2000 to the firearm to restrict access to the trigger. The protrusion 3205, like the knobs 156 or 2301, extends inside the trigger guard. In an embodiment, the protrusion 3205 (and the protrusions 156 or 2301) can be adjustable. The locking protrusion 3205 can be adjustable in height to account for different width trigger guards. The locking protrusion 3205 may extend into the trigger guard and through to the other side of the trigger guard. In an example, the locking protrusion 3205 does not extend past the trigger guard. The locking protrusion 3205 may further be rotatable or have different shapes to appropriately engage the trigger guard to secure the safety apparatus to the trigger guard. A protective layer 3207 may be on the locking knob and other areas of the adapters 3001, 3003 that may contact the firearm, e.g., the trigger guard. The protective layer 3207 may include a foam layer, a rubber layer, soft polymer layer or another cushioning material to protect the firearm, e.g., from scratches. The protective layer 3207 may also assist in providing a snug fit to the firearm and assist in preventing tampering.

Figure 33:
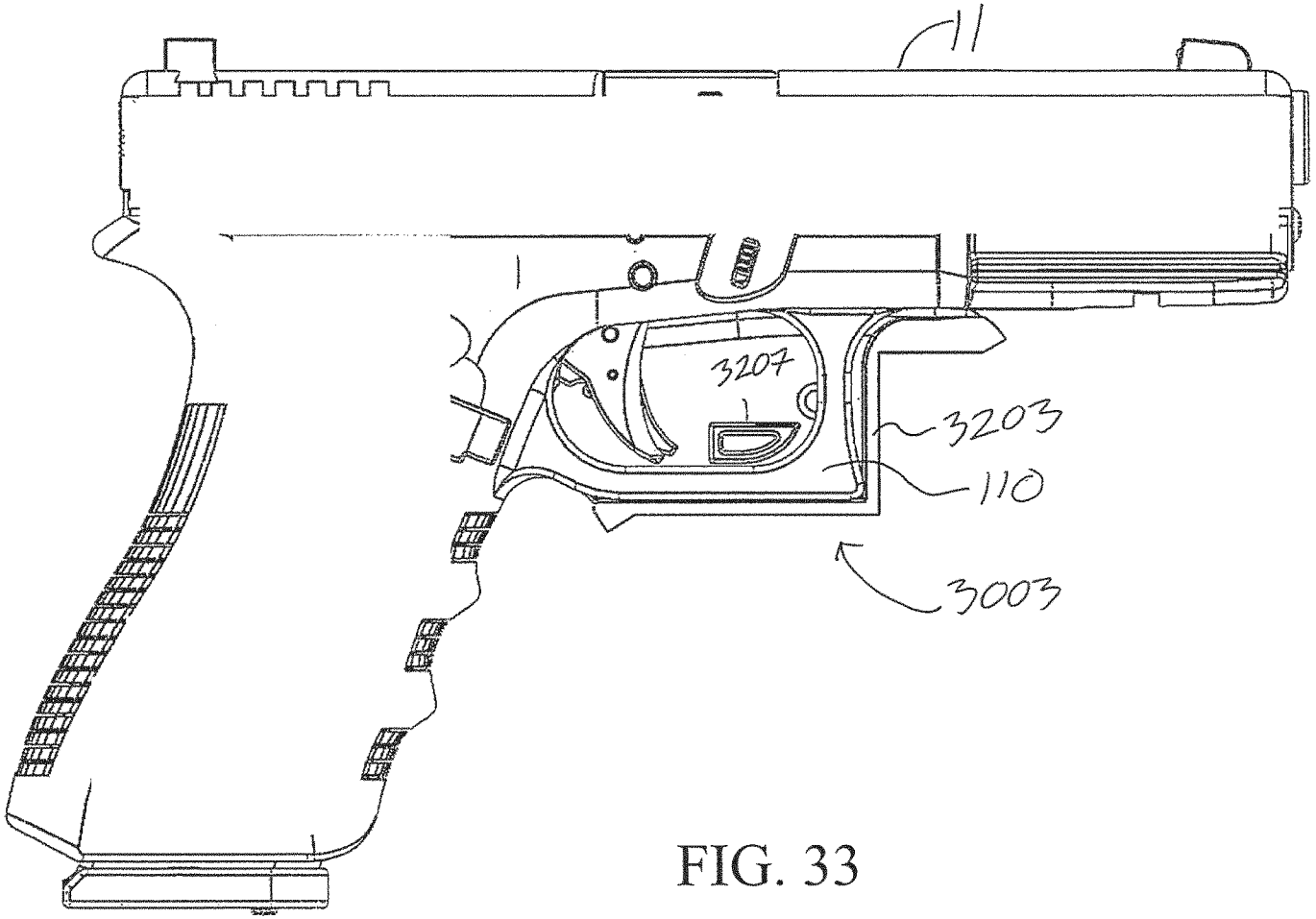
FIG. 33 is a side view of an insert for a firearm safety apparatus positioned on a firearm according to an example embodiment.

FIG. 33 shows the adapter 3003 engaged on the trigger guard of the firearm 11. The wall 3203 is shaped to extend snugly along the outer surface of the trigger guard. As shown, the wall 3202 extends along a front surface of the trigger guard and bottom surface of the trigger guard. A like wall from the other adapter 3005 may also extend along the front surface of the trigger guard and the bottom surface of the trigger guard and mate to the wall 3202, e.g., with overlapping lips. Thus the two adapters 3003, 3005 both enclose the outer surface of the trigger guard 110 remote from the barrel and the grip or stock. The adapter 3005 is not shown for clarity of illustration. The knob 3207 extends inside the trigger guard 110 forwardly of the trigger. The knob 3207 can be shaped to match the interior contour of the trigger guard 110, e.g., at the forward end of the trigger guard, where the trigger guard changes direction at its forward side. The knob 3207 prevents the adapter 3003 and safety apparatus from shifting forward. The knob 3207 and the wall 3203 grip the trigger guard with the adapter, e.g., the plate 3201, completely covering the trigger to prevent access thereto. For example, the plate 3201 extends rearwardly relative to the firearm 11 to cover the trigger and trigger guard back to the grip and up to the barrel. The knob 3207 prevents the safety device from shifting forward and the wall 3203 prevents the safety device from shifting rearwardly.

The present disclosure describes quick access to a firearm by release of trigger guard from the firearm. Quick access in some examples is less than 30 seconds, in other examples quick access is less that 20 seconds. In some examples, quick access is about 10.0-15.0 seconds or less. In some examples, quick access is about 5.0-10.0 seconds. Accordingly, when access is needed an authorized person can gain access to the firearm.

The safety apparatus is designed such that all user interactions like key-lock, sensor input, button input and charging port are located away from barrel. This is done to reduce the likelihood of user from handling a firearm in unsafe manner where unintentional discharge could result in accident.

The foregoing description is illustrative of particular embodiments of the invention, but is not meant to be a limitation upon the practice thereof. The following claims, including all equivalents thereof, are intended to define the scope of the invention

What is claimed is:

1. A firearm safety apparatus comprising:

a housing to prevent access to a trigger of a firearm, the housing having a first locking arm and a second locking arm pivotally joined to the first locking arm at a joint, wherein the first arm and the second arm being movable from a closed position configured to engage a firearm and to prevent access to a trigger on the firearm to an open position allowing access to the trigger, wherein at least one of the first arm and the second arm include a wall to grip the outside of a trigger guard and a protrusion inside the trigger guard with the first arm and the second arm mated together to be gap free in the closed position, wherein the first locking arm includes a catch;

a spring to bias at least one of the first locking arm and the second locking arm in the open position;

a locking mechanism retaining said first and second locking arms in the closed position until opened by an electrical activation signal allowing the spring to open the housing, wherein the locking mechanism includes a mechanical lock to unlock said first and second locking arms from the closed position to the open position, wherein the locking mechanism further includes a shape memory alloy wire housed within the first arm or the second arm to control the movement of said first and second locking arms from the closed position to the open position, wherein the locking mechanism includes a latch pivotally mounted to the first locking arm at a pivoting end and has a free end, wherein the latch is moveable relative to the catch when the activation signal is issued or the mechanical lock moves the latch;

a biometric sensor to sense a user at the firearm;

controller circuitry to receive a signal from the biometric sensor and to match the received signal to a stored signal and when a match is found send the activation signal to the locking mechanism to actuate the shape memory alloy wire to open the housing and allow access to the trigger of the firearm; and wherein the shape memory alloy wire is operably connected to the latch, wherein the shape memory alloy wire retracts when the activation signal is received to move the latch from the catch and allow the first locking arm and the second locking arm to move apart and allow access to the trigger of a firearm, and wherein the housing is released from the firearm when in the open position.

2. The firearm safety apparatus according to claim 1, wherein the mechanical lock includes a key tumbler and linkage connecting the key tumbler to the latch to move the latch to the unlatched position upon movement of the key tumbler.

3. The firearm safety apparatus according to claim 2, wherein the controller circuitry includes a rechargeable power source and a memory to store at least one fingerprint profile, wherein the controller circuitry has a training mode to store a fingerprint profile at the biometric sensor in the memory and an access mode that compares an access fingerprint profile at biometric sensor to the fingerprint profile stored in the memory.

4. The firearm safety apparatus according to claim 2, wherein the first arm is biased away from the second arm, wherein the first arm and second arm are openable to about 10 degrees to release the trigger guard, wherein the joint defines a pivot line, wherein the latch extends at an angle between about 50 degrees to 65 degrees relative to the pivot line, wherein the shape memory alloy wire extends at an angle in a range of about 25 degrees to 35 degrees relative to the pivot line; and wherein the housing is shaped to leave a space between the housing a firearm grip such that a user can hold the grip with the housing being in the closed position preventing access to the trigger.

5. The firearm safety apparatus according to claim 1, wherein the joint defines an elongate pivot axis that is outside the trigger guard and extends non-parallel to a gun barrel with the housing in the closed position on the trigger guard.

6. The firearm safety apparatus according to claim 1, wherein the wall extends in front of an end of the trigger guard, wherein the protrusion extends inside the trigger guard, and wherein the wall and the protrusion prevent longitudinal movement of the housing in the closed position.

7. The firearm safety apparatus according to claim 6, wherein the protrusion cantilevers from an inside of the first locking arm and is free from contact to the second locking arm in the closed position.

8. The firearm safety apparatus of claim 1, wherein the housing is configured to engage a holster to allow the firearm with the firearm safety apparatus to be worn by a user.

9. The firearm safety apparatus of claim 8, wherein the housing includes a hook protrusion to engage the holster.

10. The firearm safety apparatus of claim 1, wherein the housing is configured to be worn holster-like to hold the firearm on a user's body when secured by the first locking arm and the second locking arm, and wherein the second locking arm includes a plurality of interior walls to block direct access to the latch through the joint.

11. The firearm safety apparatus of claim 1, wherein the first locking arm closes on the trigger guard with the firearm secured in a holster.

* * * * *